US011111075B2

(12) United States Patent
Foster et al.

(10) Patent No.: US 11,111,075 B2
(45) Date of Patent: Sep. 7, 2021

(54) ROLL OUT CART WITH BITE GUARD

(71) Applicant: Rehrig Pacific Company, Los Angeles, CA (US)

(72) Inventors: Derick Foster, Cumming, GA (US); John Matthew Thomson, Johns Creek, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 16/851,379

(22) Filed: Apr. 17, 2020

(65) Prior Publication Data

US 2020/0331696 A1 Oct. 22, 2020

Related U.S. Application Data

(60) Provisional application No. 62/835,467, filed on Apr. 17, 2019.

(51) Int. Cl.
*B65F 1/16* (2006.01)
*B65F 1/14* (2006.01)

(52) U.S. Cl.
CPC ..... *B65F 1/1615* (2013.01); *B65F 1/1468* (2013.01)

(58) Field of Classification Search
CPC ..... B65F 1/1615; E05B 13/001; A01M 29/30
USPC ..... 220/730
See application file for complete search history.

(56) References Cited

U.S. PATENT DOCUMENTS

| | | | | |
|---|---|---|---|---|
| 372,680 | A | 11/1887 | Ketcham | |
| 3,490,637 | A | 1/1970 | Pope | |
| 4,286,636 | A | 9/1981 | Credle | |
| 4,319,762 | A | 3/1982 | Streit et al. | |
| 4,384,656 | A | 5/1983 | McQuiston et al. | |
| 4,976,364 | A | 12/1990 | Solomon | |
| 5,490,606 | A | 12/1996 | Lombardo | |
| 5,960,983 | A | 10/1999 | Chan | |
| 6,135,311 | A | 10/2000 | Panec et al. | |
| 6,250,492 | B1 | 6/2001 | Verbeek | |
| 6,350,418 | B1 | 2/2002 | Venderpool et al. | |
| 6,666,485 | B1 * | 12/2003 | Moret | B65F 1/1615 220/315 |
| 7,073,677 | B2 | 7/2006 | Richardson et al. | |
| 7,204,382 | B2 | 4/2007 | Cezeaux | |
| 7,559,433 | B2 | 7/2009 | Yang et al. | |
| 7,775,394 | B2 | 8/2010 | Naesje | |
| 7,775,564 | B2 * | 8/2010 | Moore | E05B 65/06 292/37 |
| 7,918,362 | B2 | 4/2011 | Schmitt | |
| 8,505,783 | B2 | 8/2013 | Gill et al. | |
| 9,346,616 | B2 | 5/2016 | Foster | |
| D839,074 | S | 1/2019 | Fink et al. | |

(Continued)

*Primary Examiner* — Allan D Stevens
(74) *Attorney, Agent, or Firm* — Carlson, Gaskey & Olds, P.C.

(57) ABSTRACT

A roll-out cart includes a container body having a side wall extending upward to a mouth of the container body. A lid is pivotably connected to a rear portion of the container body. The lid is pivotable between an open position and a closed position covering the mouth of the container body. A latch selectively secures a front portion of the lid to a front portion of the container body. The latch includes an outer latch assembly having a first actuator. A guard defines a recess on the front portion of the container body. The first actuator of the latch is within the recess.

21 Claims, 24 Drawing Sheets

(56) References Cited

U.S. PATENT DOCUMENTS

| | | | | |
|---|---|---|---|---|
| 2005/0121405 | A1 | 6/2005 | Drajan | |
| 2006/0043099 | A1 | 3/2006 | Zer et al. | |
| 2006/0283896 | A1 | 12/2006 | Kasting | |
| 2007/0084865 | A1* | 4/2007 | Moore | E05C 3/06 220/326 |
| 2007/0175910 | A1 | 8/2007 | Hogarth et al. | |
| 2009/0223965 | A1* | 9/2009 | Raghunathan | B65F 1/1468 220/324 |
| 2009/0245981 | A1 | 10/2009 | Miyajima et al. | |
| 2010/0108700 | A1 | 5/2010 | Scott | |
| 2011/0248054 | A1 | 10/2011 | Darby | |
| 2012/0000909 | A1 | 1/2012 | Chameroy et al. | |
| 2013/0214012 | A1 | 8/2013 | Pils et al. | |
| 2014/0299619 | A1 | 10/2014 | Foster | |
| 2017/0022005 | A1 | 1/2017 | Foster | |
| 2017/0022006 | A1 | 1/2017 | Foster | |
| 2018/0044941 | A1* | 2/2018 | Fink | E05B 15/0093 |
| 2018/0319589 | A1 | 11/2018 | Foster | |

* cited by examiner

ROLL OUT CART WITH BITE GUARD

BACKGROUND

Trash and recycling containers, such as roll-out carts, generally include a container body and a lid pivotably connected to the container body. Some carts include a latch selectively retaining the lid in the closed position. One type of latch includes a pair of opposed actuators on the exterior of the container body. To release the latch, a user squeezes the two actuators toward one another.

SUMMARY

A roll-out cart includes a container body having a side wall extending upward to a mouth of the container body. A lid is pivotably connected to a rear portion of the container body. The lid is pivotable between an open position and a closed position covering the mouth of the container body. A latch selectively secures a front portion of the lid to a front portion of the container body. The latch includes an outer latch assembly having a first actuator. A guard defines a recess on the front portion of the container body. The first actuator of the latch is within the recess. The guard prevents actuation of the latch by animals, such as bears, biting the first actuator.

DETAILED DESCRIPTION

Figure 1:
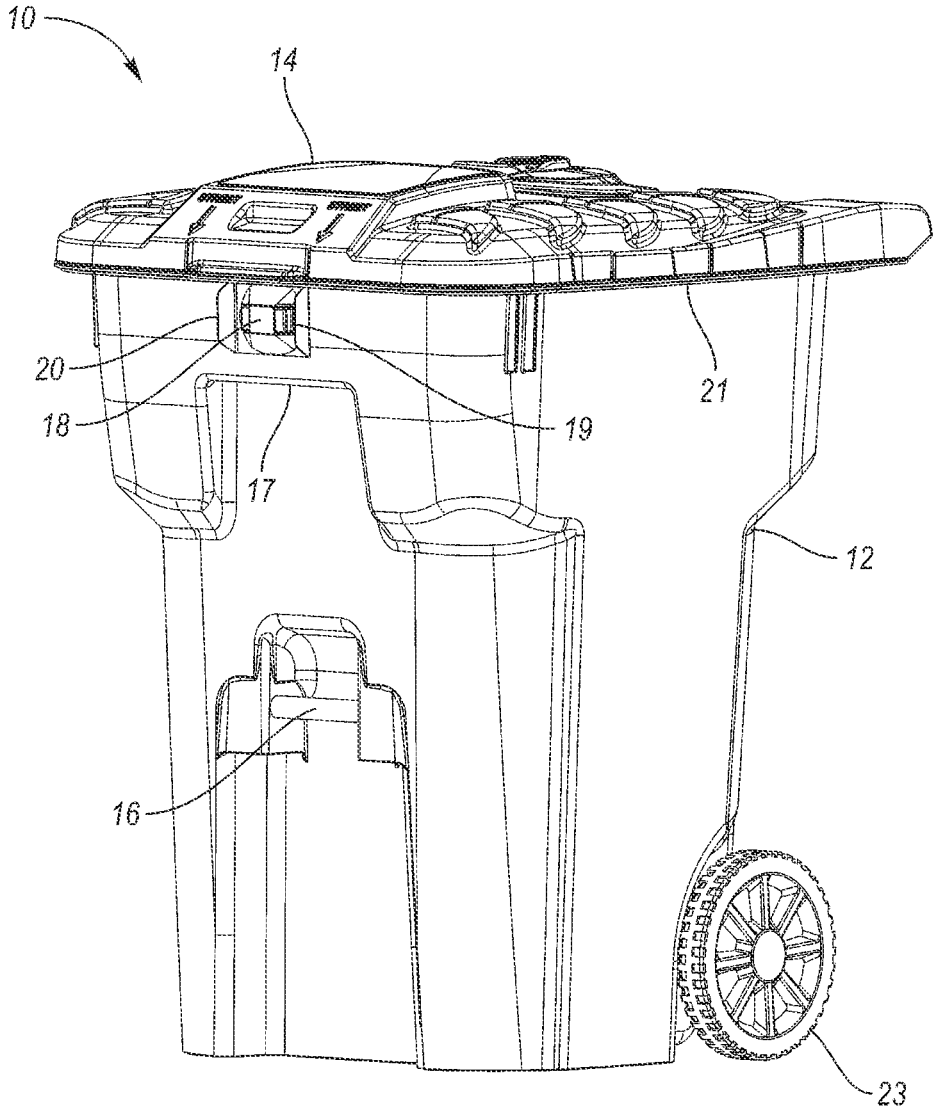
FIG. 1 is a front perspective view of a roll-out cart according to one embodiment.

A roll-out cart 10 designed to be resistant to bears and other large animals is shown in FIG. 1. The roll-out cart 10 includes a container body 12 and lid 14. The lid 14 is pivotably connected at a rearward portion of the roll-out cart 10. The lid 14 is selectively connected to the container body 12 at a forward portion of the roll-out cart 10 by a latch 19 including an outer latch assembly 18. The latch 19 is secured to the container body 12 and selectively captures a latch member secured to the front portion of the lid 14 in a known manner. The latch 19 may be a gravity-activated latch 19, such that it becomes unlatched automatically when the roll-out cart 10 is inverted, such as when it is being dumped by a lift arm on a collection truck. Latches 19 of this type are known. To prevent actuation of the latch 19 by animals, particularly bears, or inadvertent actuation, a guard 20 is provided around the outer latch assembly 18.

The front of the container body 12 has a horizontal grab bar 16 which provides a lower grab point. The front of the container body 12 also includes an upper grab point 17, which is a molded undercut or hook, molded integrally with the container body 12. Both the grab bar 16 and the upper grab point 17 are used by automated equipment for lifting and dumping the roll-out cart 10 into a collection vehicle.

The container body 12 a side wall extending upward from a base wall to a mouth of the container body 12 to define an internal volume, which in the example shown is approximately 95 gallons. A lip 21 projects outward and then downward from the entire periphery of the uppermost edge of the side wall. The outer latch assembly 18 is positioned just below the lip 21. Wheels 23 are mounted to a lower rear portion of the container body 12.

Figure 2:
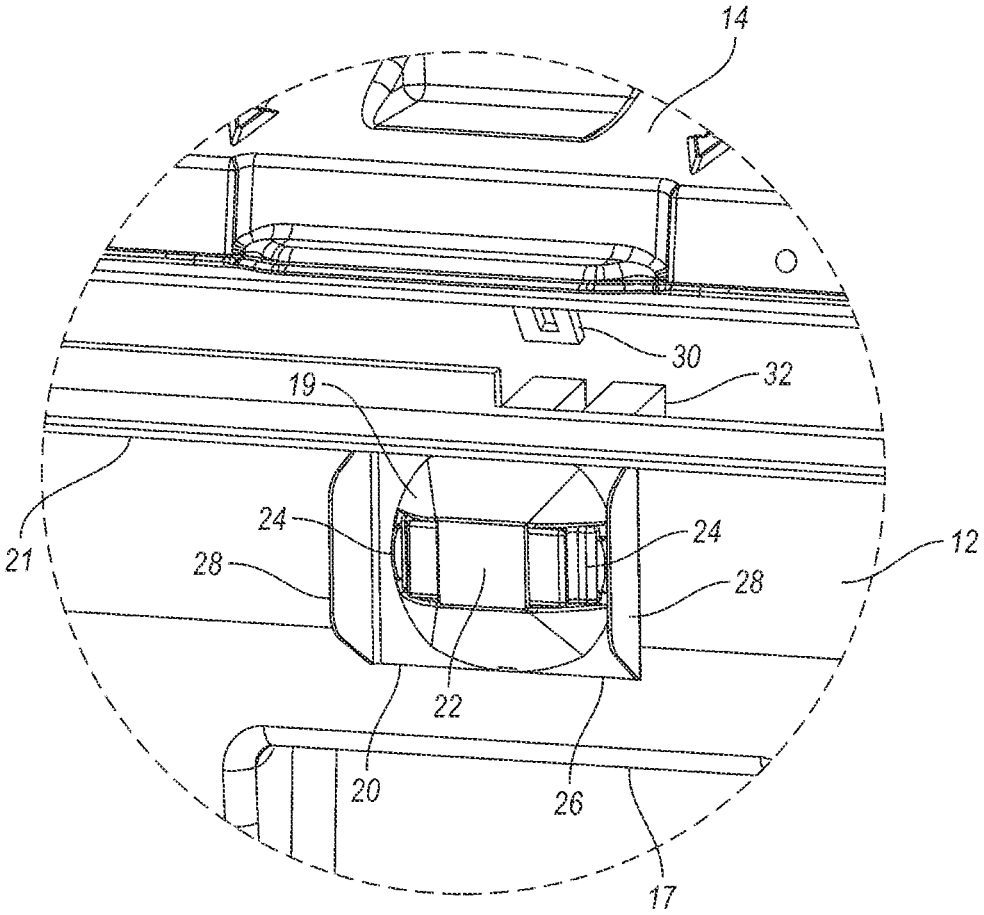
FIG. 2 is an enlarged view of the area of the latch and guard of FIG. 1, with the lid partially open and the container body wall partially broken away.

FIG. 2 is an enlarged view of the area of latch 19 of FIG. 1, with the lid 14 partially opened. As can be seen, the latch 19 includes an internal latch body 32 containing the mechanisms for selectively securing the hasp 30 to the latch body. A pair of latch actuators 24 are positioned on opposite sides of the latch body 22. A hasp 30 secured to the lid 14 is selectively secured to the internal latch assembly 32, which may include a gravity release mechanism, such that the latch is released when the roll-out cart 10 is inverted, such as when it is being emptied by automated handling equipment.

When a user grasps both latch actuators 24 in one hand and squeezes them toward one another, then the internal latch assembly 32 releases the hasp 30, thereby releasing the lid 14 from the container body 12. The guard 20 prevents a bear or other animal from biting the outer latch assembly 18 and squeezing the latch actuators 24 toward one another. The guard 20 includes a rear plate portion 26 and a pair of opposite fins 28 protruding outward (forward) therefrom. The guard 20 defines a recess between the fins 28 in which the outer latch assembly 18, particularly the latch actuators 24, are received. The outer latch assembly 18 is positioned between the fins 28 such that the fins 28 are aligned with and spaced outward of the latch actuators 24. There is sufficient space between the fins 28 and the latch actuators 24 to permit a user's fingers to be inserted therebetween and squeeze the actuators 24. There is not sufficient space for an animal's upper or lower jaw to fit between either of the fins 28 and one of the actuators 24.

Figure 4:
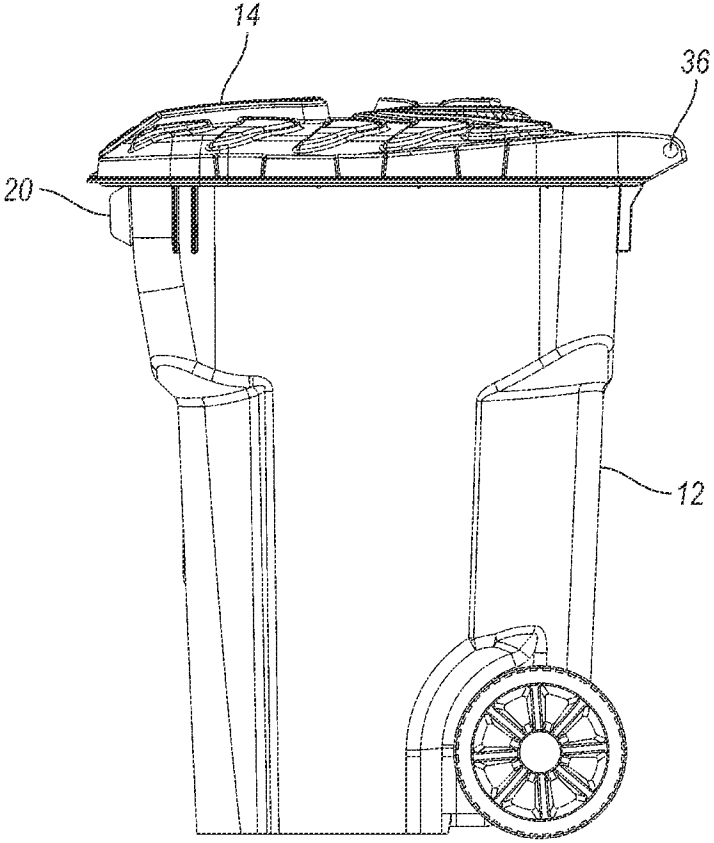
FIG. 4 is a side view of the roll-out cart of FIG. 1.
Figure 3:
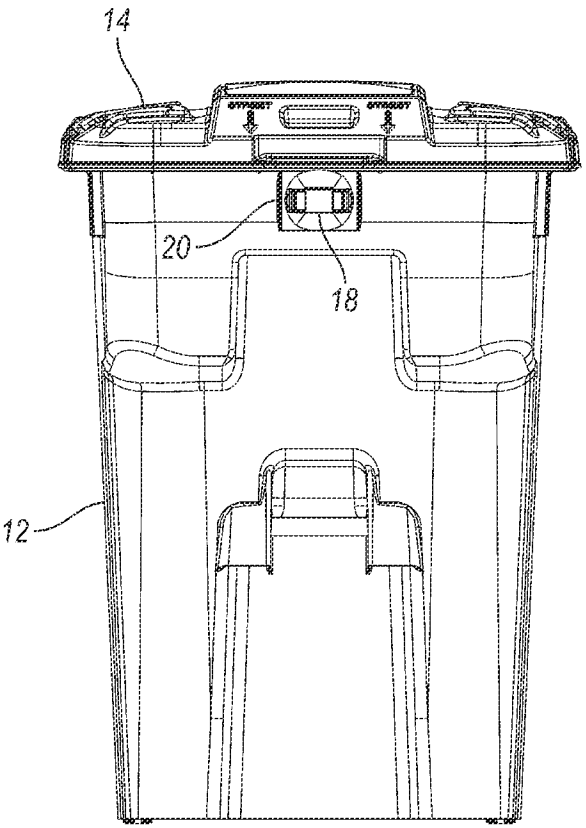
FIG. 3 is a front view of the roll-out cart of FIG. 1.

FIG. 3 is a front view of the roll-out cart 10. FIG. 4 is a side view of the roll-out cart 10. The lid 14 pivots on an axis 36 positioned rearward of the container body 12 side wall. The axis 36 extends through a rear handle.

Figure 5:
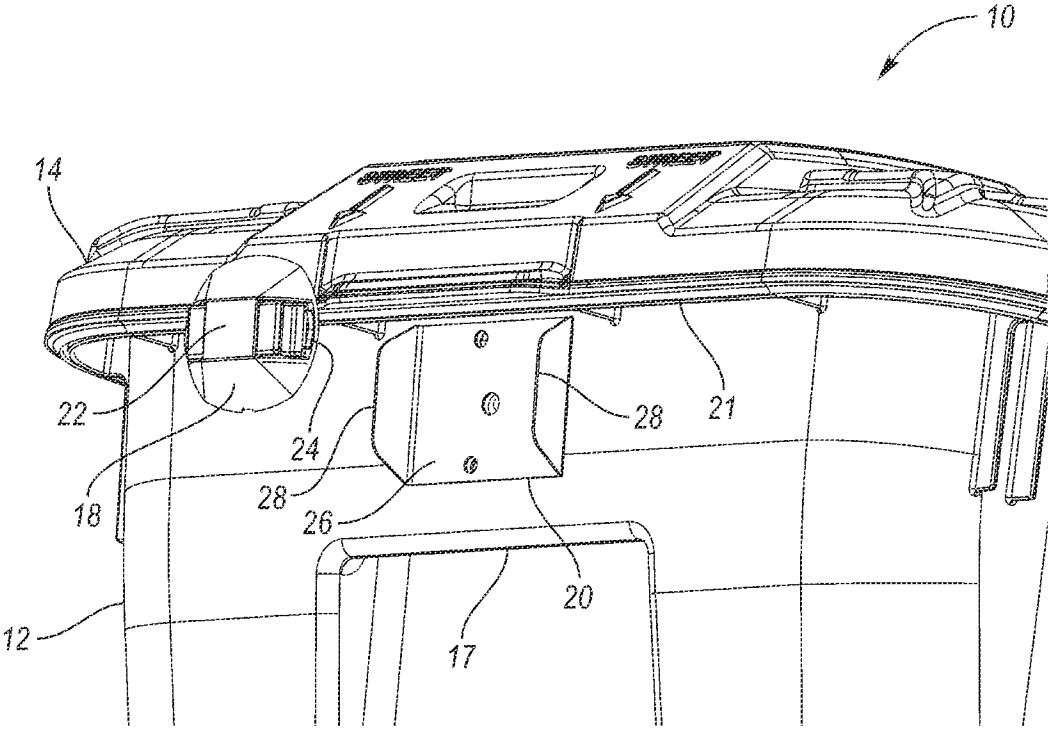
FIG. 5 is a partially exploded view of the latch area of the roll-out cart of FIG. 1.

FIG. 5 is a partially exploded view of the latch area of the roll-out cart 10. As shown, the guard 20 is placed against the container body 12, with the rear plate portion 26 abutting the container body 12 and the fins 28 protruding forwardly of the rear plate portion 26. The outer latch assembly 18 is installed over the rear plate portion 26 and secured to the container body 12 (and the internal latch assembly 32, FIG. 2) to retain the rear plate portion 26.

FIGS. 6-10 shows an alternate roll-out cart 110, including the container body 12 and lid 14 as before. A latch 119 selectively connects the front portion of the container body 12 to the front portion of the lid 14. The latch 119 includes an outer latch assembly 118.

Figure 7:
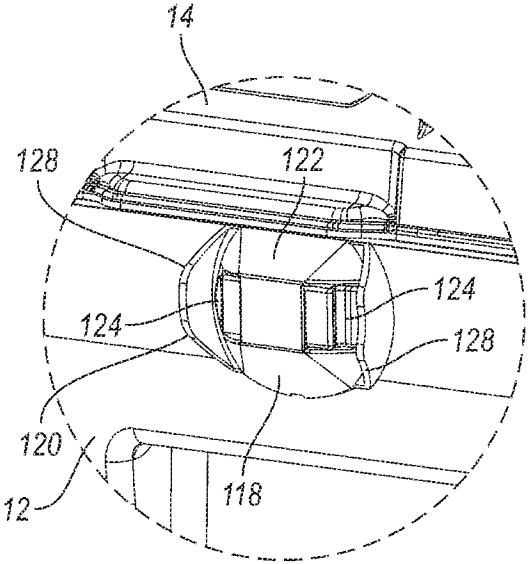
FIG. 7 is an enlarged view of the area of the latch and guard of FIG. 6.
Figure 6:
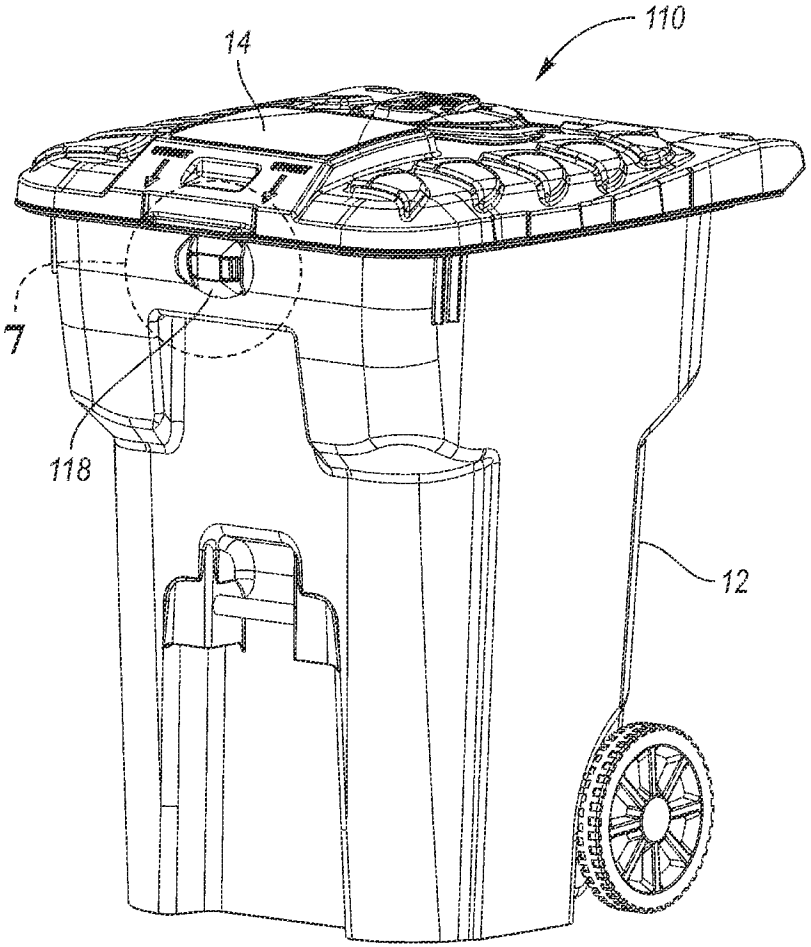
FIG. 6 is a front perspective view of a roll-out cart according to another embodiment.

FIG. 7 is an enlarged view of the outer latch assembly 118. The outer latch assembly 118 includes a latch body 122 having a pair of opposed actuators 124. In this embodiment, the outer latch assembly 118 includes an integrally-formed guard 120, including integrally-formed fins 128 protruding forwardly on either side of the outer latch assembly 118. The fins 128 are formed integrally with the outer latch assembly 118. Again, the fins 128 are spaced outwardly of the latch actuators 124 sufficiently to permit access by a user's fingers, but not the jaws of an animal. The latch actuators 124 and the latch body 122 are positioned in this recess defined by the fins 128 of the guard 120. The outer latch assembly 118 again connects to the internal latch assembly 32 (FIG. 2) as before.

Figure 9:
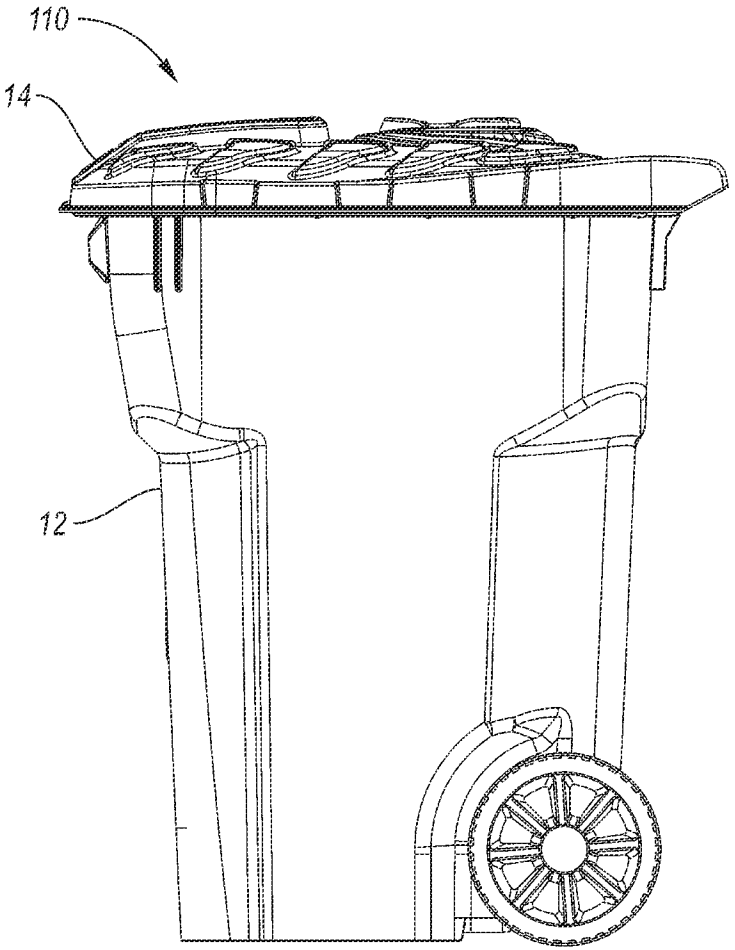
FIG. 9 is a side view of the roll-out cart of FIG. 6.
Figure 8:
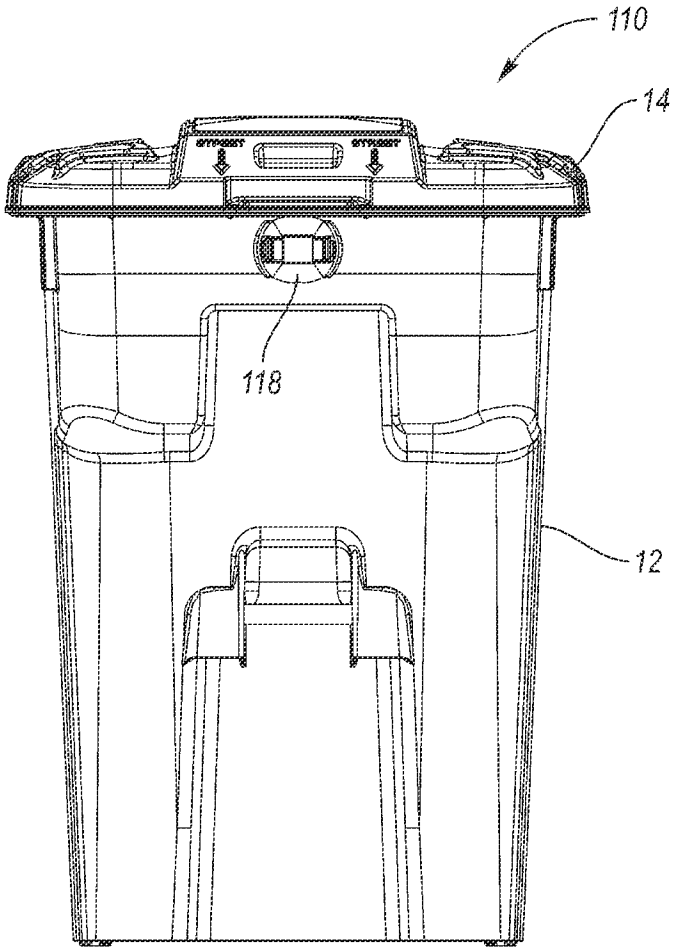
FIG. 8 is a front view of the roll-out cart of FIG. 6.

FIG. 8 is a front view of the roll-out cart 110. FIG. 9 is a side view of the roll-out cart 110.

Figure 10:
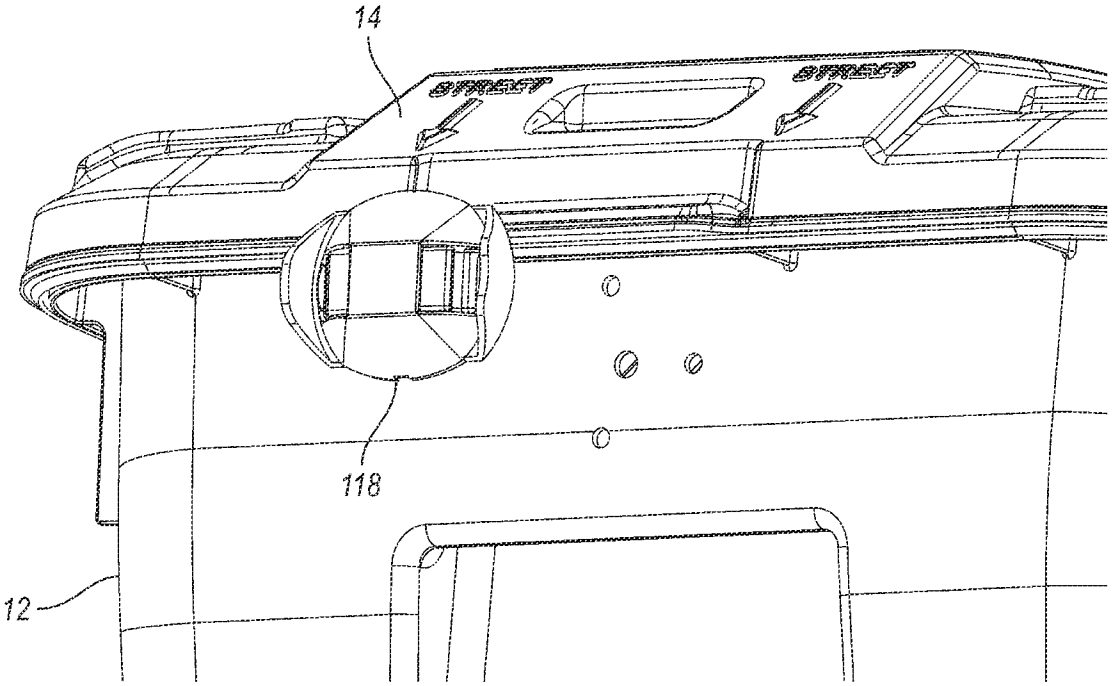
FIG. 10 is a partially exploded view of the latch area of the roll-out cart of FIG. 6.

FIG. 10 is a partially exploded view of the roll-out cart 110. As shown, the latch member 118 is a single piece with fins 128 formed integrally with the housing of the latch member 118, which can be mounted to the container body 12.

Figure 11:
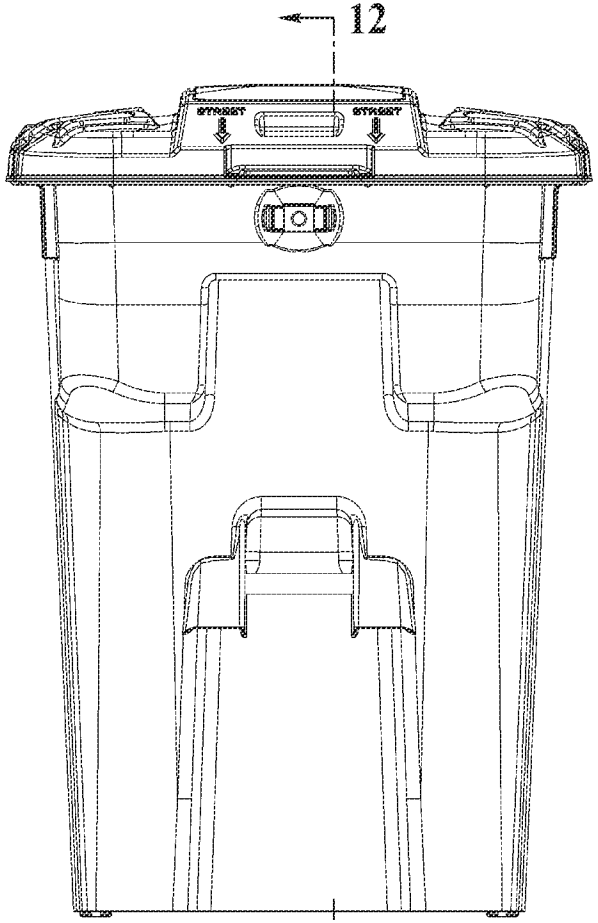
FIG. 11 is a front view of the roll-out cart of FIG. 1.
Figure 12:
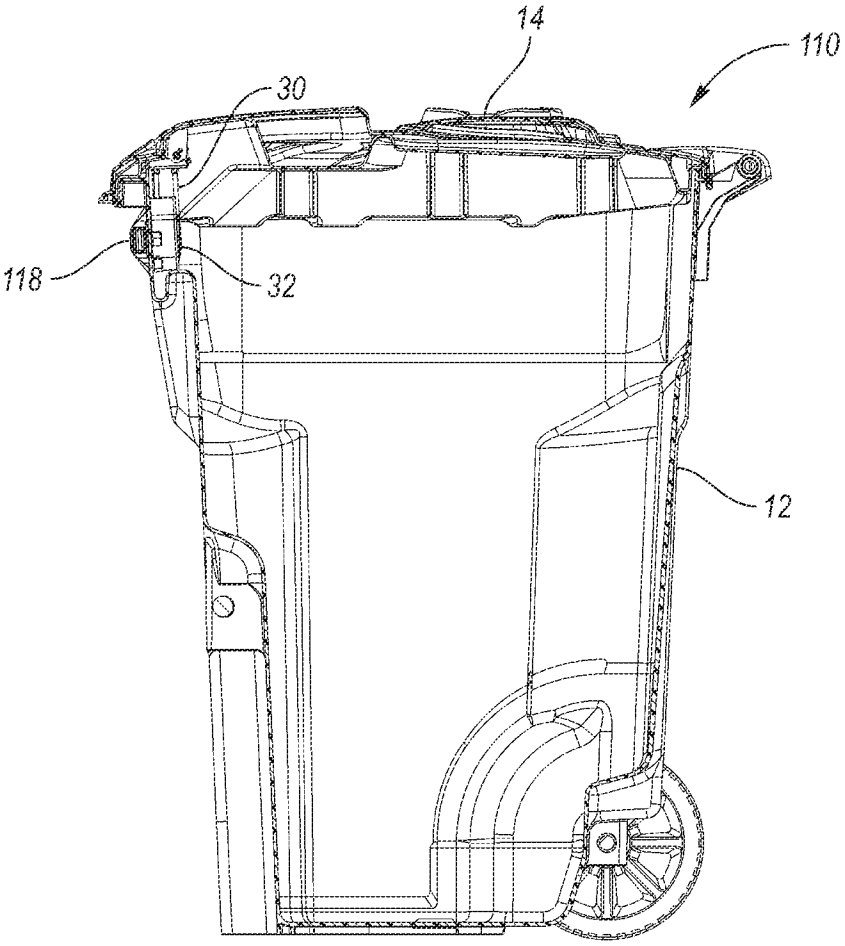
FIG. 12 is a section view taken along line 12-12 of FIG. 11.

FIG. 11 is a front view of the roll-out cart 110. FIG. 12 is a section view taken along line 12-12 of FIG. 11. Referring to FIG. 12, the outer latch assembly 118 connects to the internal latch assembly 32 which selectively connects to the hasp 30 which is secured to the lid 14.

Figure 13:
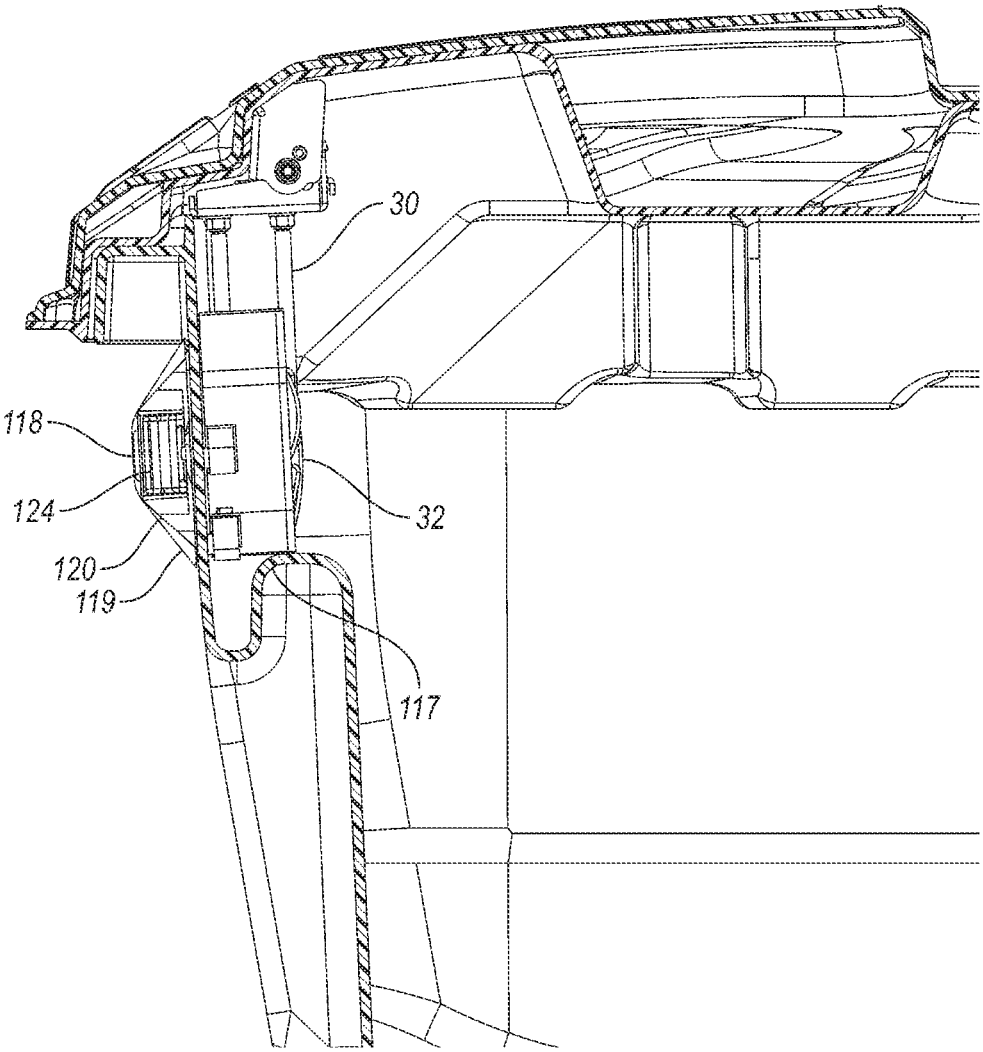
FIG. 13 is an enlarged view of the latch area of FIG. 12.

FIG. 13 is an enlarged view of the latch area of FIG. 12. Again, the outer latch assembly 118 connects to the internal latch assembly 32 to release the hasp 30 when the actuators 124 are actuated. The upper grab point 117 is below and recessed relative to the guard 120 and outer latch assembly 118.

Figure 14:
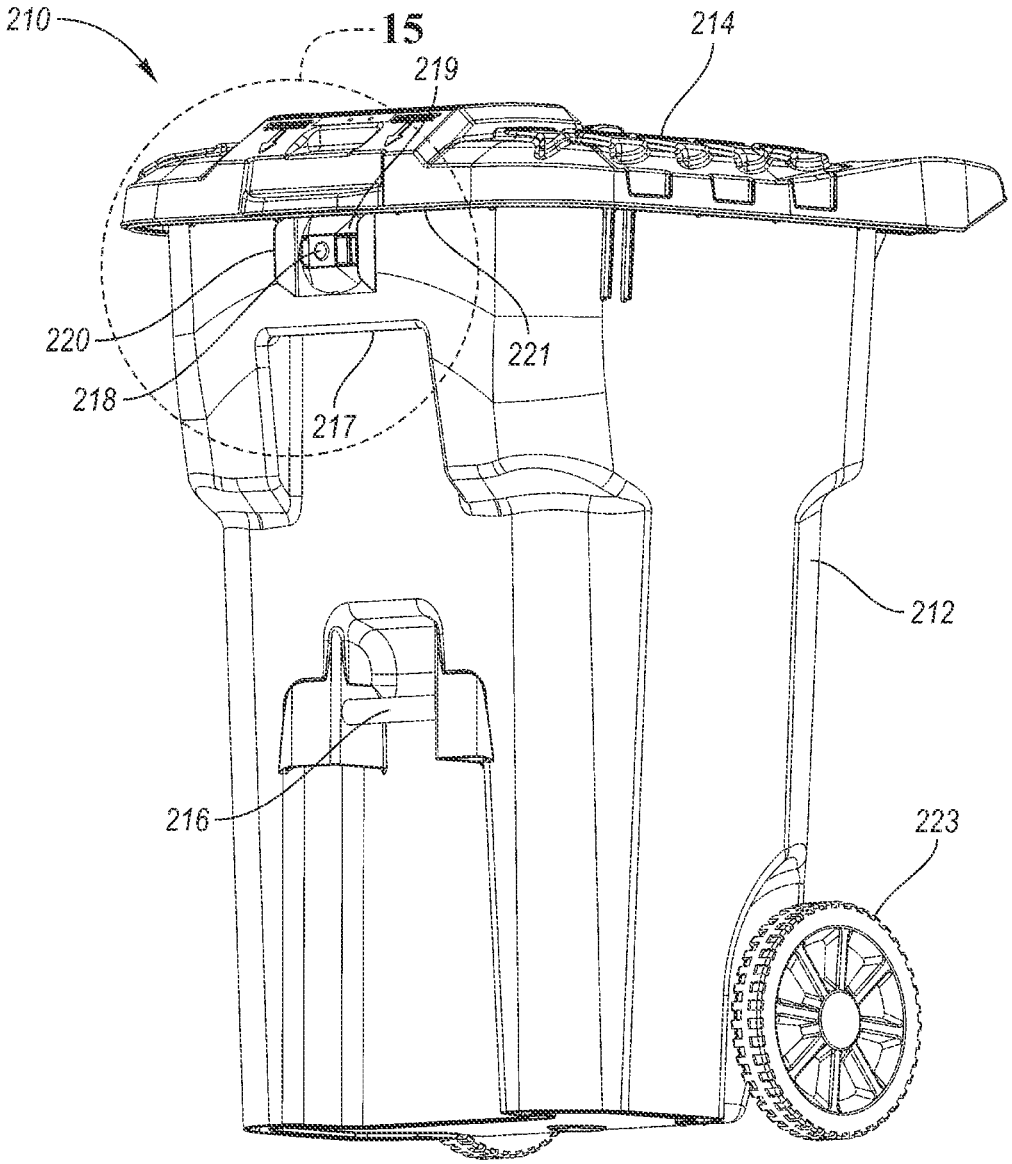
FIG. 14 is a front perspective view of a roll-out cart according to another embodiment.

A roll-out cart 210 according to another embodiment is shown in FIG. 14. The roll-out cart 210 includes a container body 212 and lid 214. The lid 214 is pivotably connected at a rearward portion of the roll-out cart 210. The lid 214 is selectively connected to the container body 212 at a forward portion of the roll-out cart 210 by a latch 219 including an outer latch assembly 218. The latch 219 is secured to the container body 212 and selectively captures a latch member secured to the front portion of the lid 214 as before. To prevent actuation of the latch 219 by animals, particularly bears, or inadvertent actuation, a guard 220 is provided around the outer latch assembly 218. The container body 212 has a smaller volume compared to the container body of the previous embodiments, for example, the container body 212 shown has an internal volume of approximately 65 gallons.

The front of the container body 212 has a horizontal grab bar 216 which provides a lower grab point. The front of the container body 212 also includes an upper grab point 217, which is a molded undercut or hook, molded integrally with the container body 212. Both the grab bar 216 and the upper grab point 217 are used by automated equipment for lifting and dumping the roll-out cart 210 into a collection vehicle.

The container body 212 includes a side wall extending upward from a base wall to a mouth of the container body 212. A lip 221 projects outward and then downward from the entire periphery of the uppermost edge of the side wall. The outer latch assembly 218 is positioned just below the lip 221. Wheels 223 are mounted to a lower rear portion of the container body 212.

Figure 15:
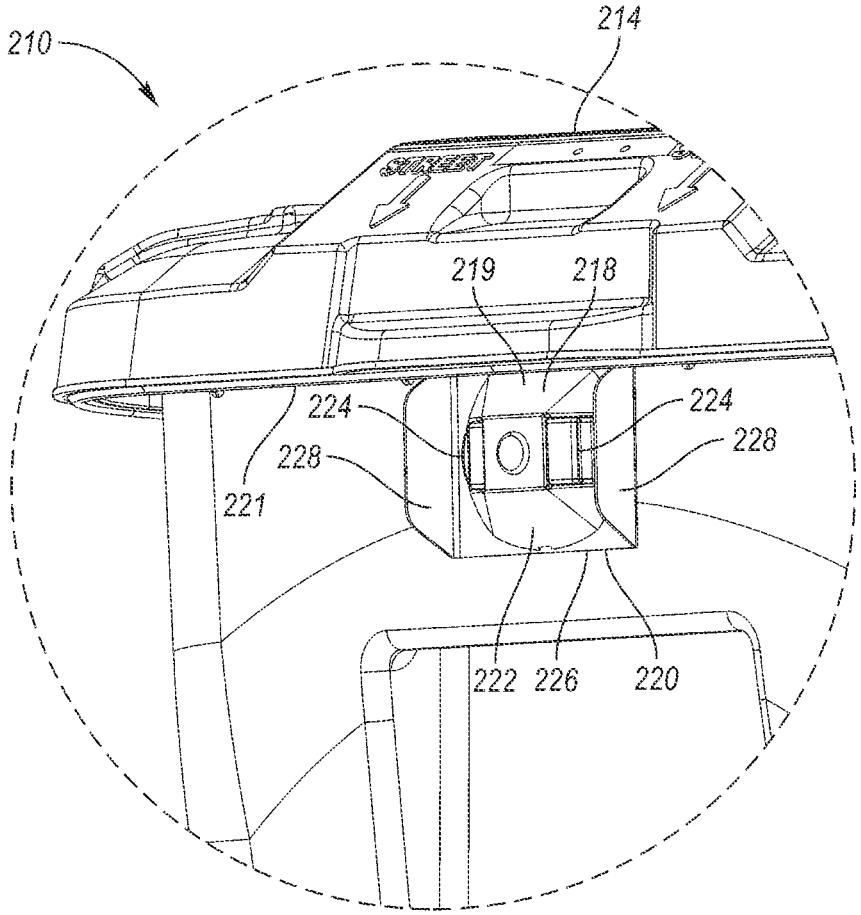
FIG. 15 is an enlarged view of the area of the latch and guard of FIG. 14.

FIG. 15 is an enlarged view of the area of latch 219 of FIG. 14. A pair of latch actuators 224 are positioned on opposite sides of the latch body 222. When a user grasps both latch actuators 224 in one hand and squeezes them toward one another, then the internal latch assembly 32 (FIG. 13) releases the hasp (not shown, as before), thereby releasing the lid 214 from the container body 212. The guard 220 prevents a bear or other animal from biting the outer latch assembly 218 and squeezing the latch actuators 224 toward one another. The guard 220 includes a rear plate portion 226 and a pair of opposite fins 228 protruding outward (forward) therefrom. The guard 220 defines a recess between the fins 228 in which the outer latch assembly 218, particularly the latch actuators 224, are received. The outer latch assembly 218 is positioned between the fins 228 such that the fins 228 are aligned with and spaced outward of the latch actuators 224. There is sufficient space between the fins 228 and the latch actuators 224 to permit a user's fingers to be inserted therebetween and squeeze the actuators 224. There is not sufficient space for an animal's upper or lower jaw to fit between either of the fins 228 and one of the actuators 224.

Figure 17:
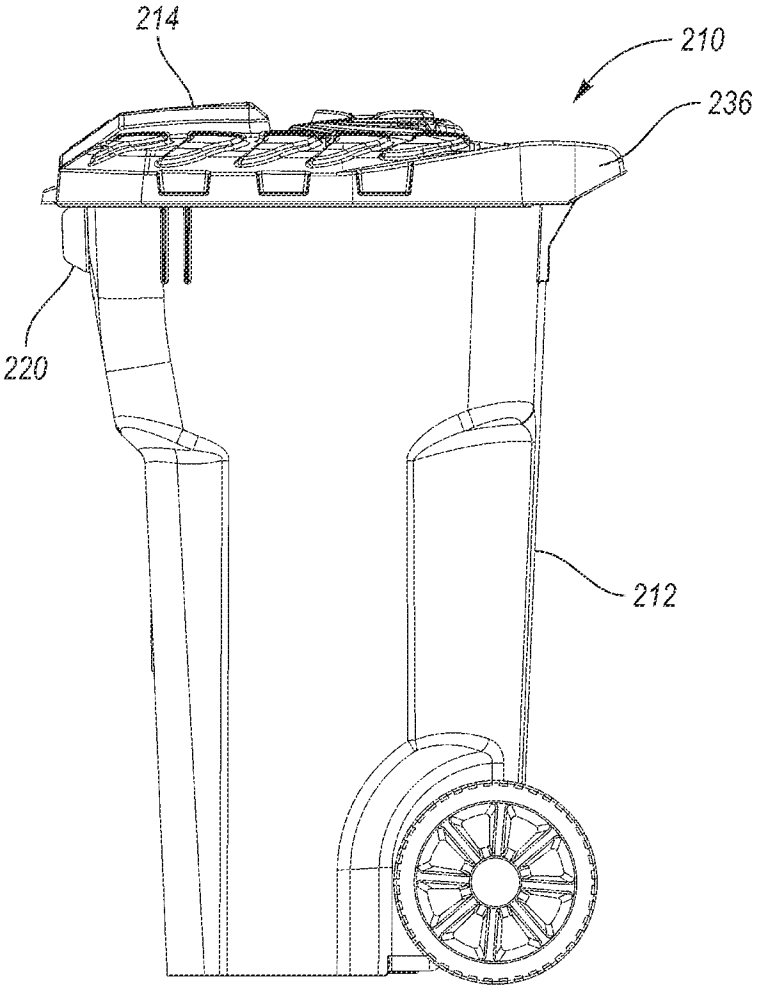
FIG. 17 is a side view of the roll-out cart of FIG. 14.
Figure 16:
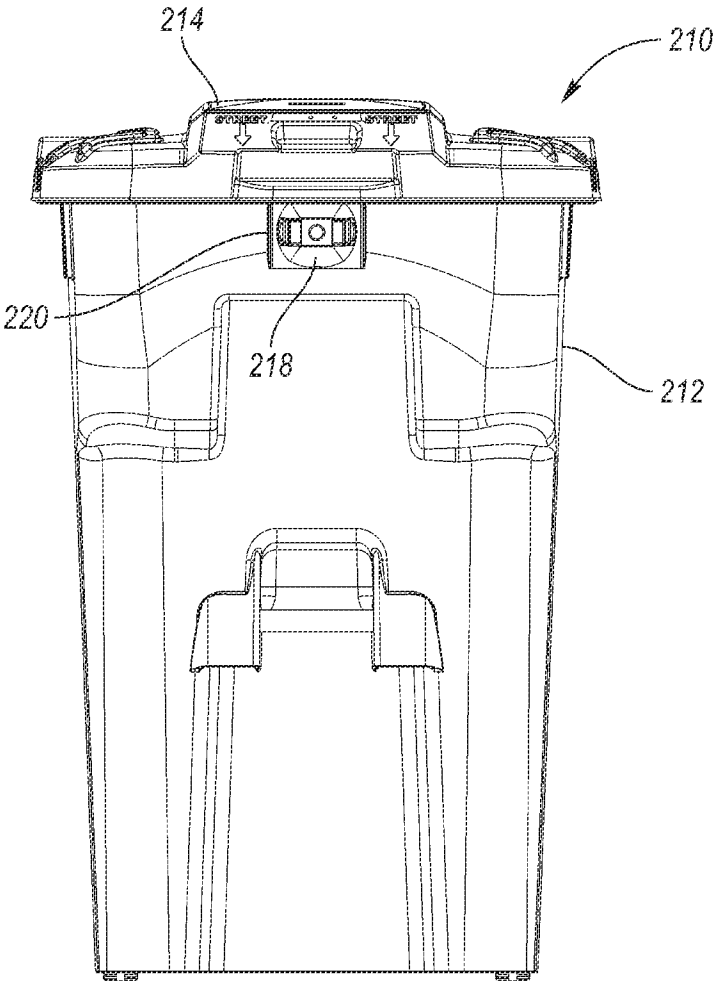
FIG. 16 is a front view of the roll-out cart of FIG. 14.

FIG. 16 is a front view of the roll-out cart 210. FIG. 17 is a side view of the roll-out cart 210. The lid 214 pivots on an axis 236 positioned rearward of the container body 212 side wall. The axis 236 extends through a rear handle.

Figure 18:
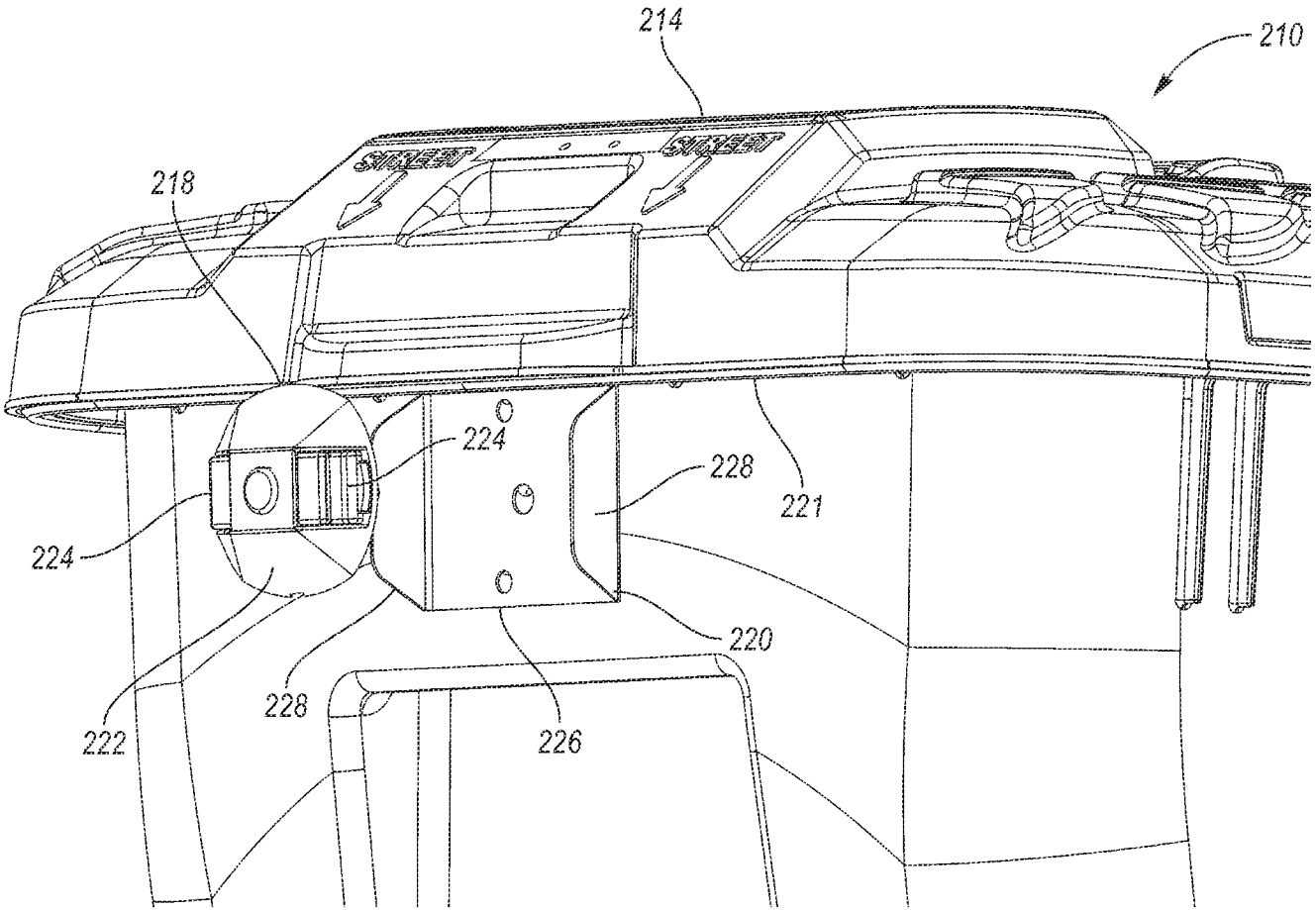
FIG. 18 is a partially exploded view of the latch area of the roll-out cart of FIG. 14.

FIG. 18 is a partially exploded view of the latch area of the roll-out cart 210. As shown, the guard 220 is placed against the container body 212, with the rear plate portion 226 abutting the container body 212 and the fins 228 protruding forwardly of the rear plate portion 226. The outer latch assembly 218 is installed over the rear plate portion 226 and secured to the container body 212 (and the internal latch assembly) to retain the rear plate portion 226.

Figure 19:
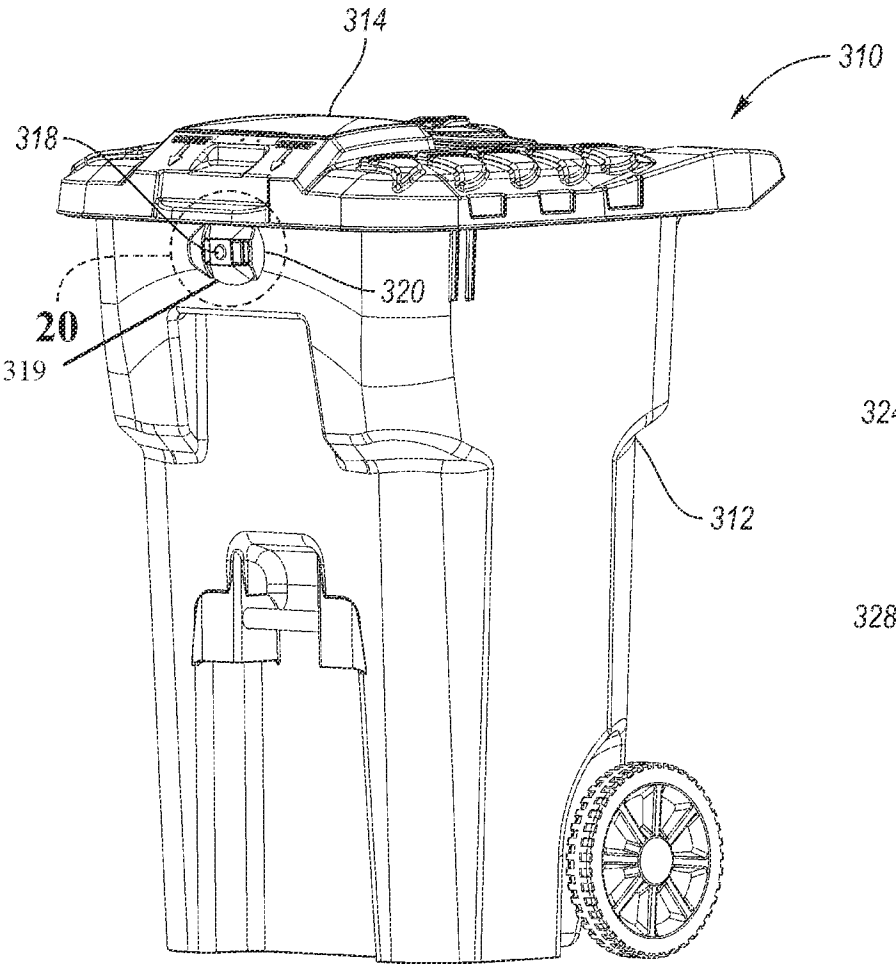
FIG. 19 is a front perspective view of a roll-out cart according to another embodiment.

FIGS. 19-24 show an alternate roll-out cart 310, including a container body 312 and lid 314. The container body 312 of FIG. 19 is the same as the container body 212 of FIG. 14. A latch 319 selectively connects the front portion of the container body 12 to the front portion of the lid 14. The latch 319 includes an outer latch assembly 318.

Figure 20:
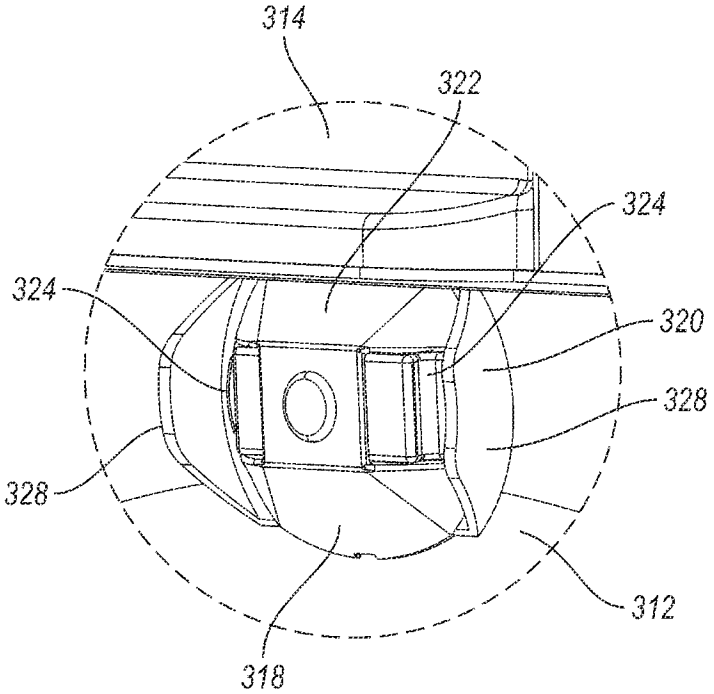
FIG. 20 is an enlarged view of the area of the latch and guard of FIG. 19.

FIG. 20 is an enlarged view of the outer latch assembly 318. The outer latch assembly 318 includes a latch body 322 having a pair of opposed actuators 324. In this embodiment, the outer latch assembly 318 includes an integrally-formed guard 320, including integrally-formed fins 328 protruding forwardly on either side of the outer latch assembly 318. The fins 328 are formed integrally with the latch body 322 of the outer latch assembly 318. Again, the fins 328 are spaced outwardly of the latch actuators 324 sufficiently to permit access by a user's fingers, but not the jaws of an animal. The latch actuators 324 and the latch body 322 are positioned in this recess defined by the fins 328 of the guard 320. The outer latch assembly 318 again connects to the internal latch assembly as before.

Figure 21:
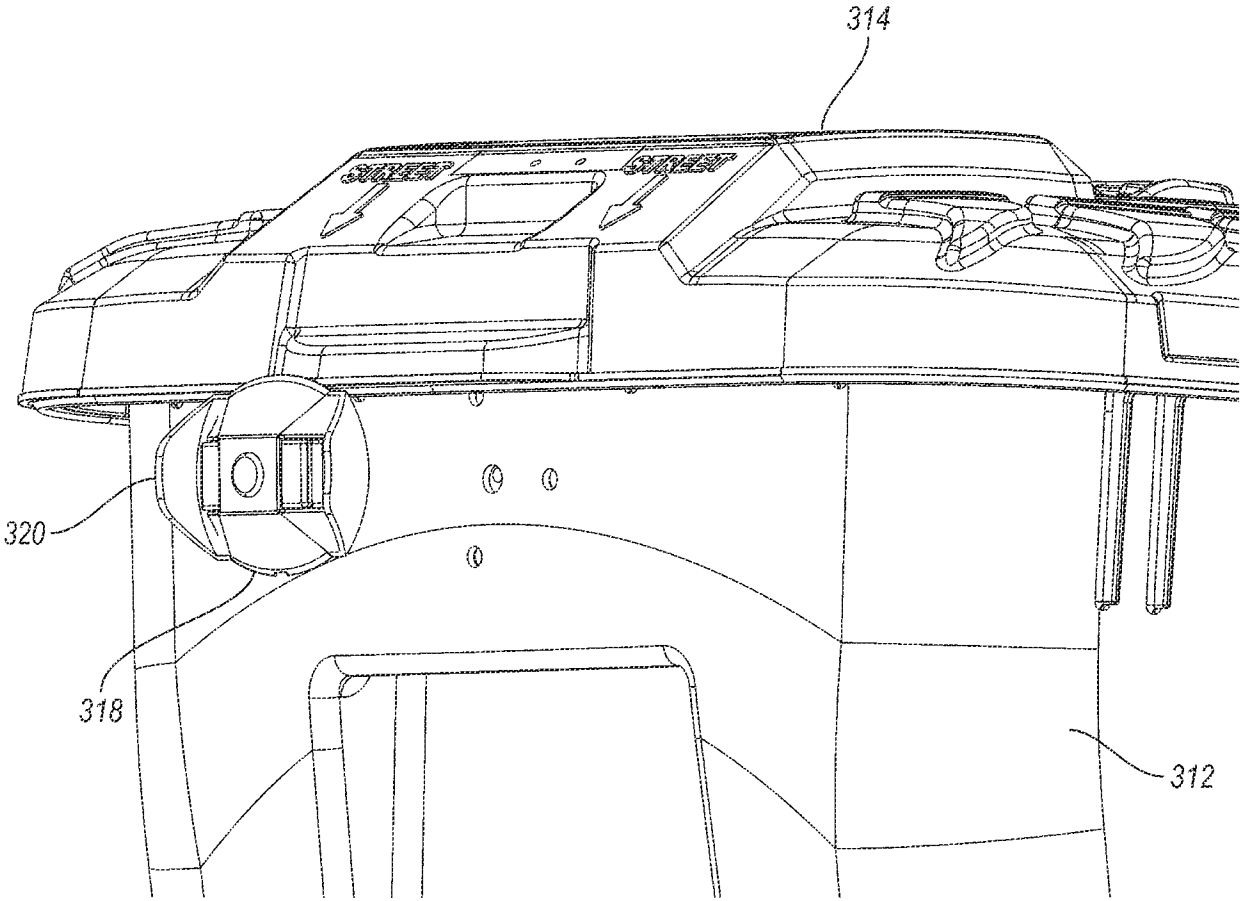
FIG. 21 is a partially exploded view of the latch area of the roll-out cart of FIG. 19.

FIG. 21 is a partially exploded view of the roll-out cart 310. As shown, the fins 328 are formed integrally with the latch body 322 of the outer latch assembly 318, which can be mounted to the container body 312.

Figure 22:
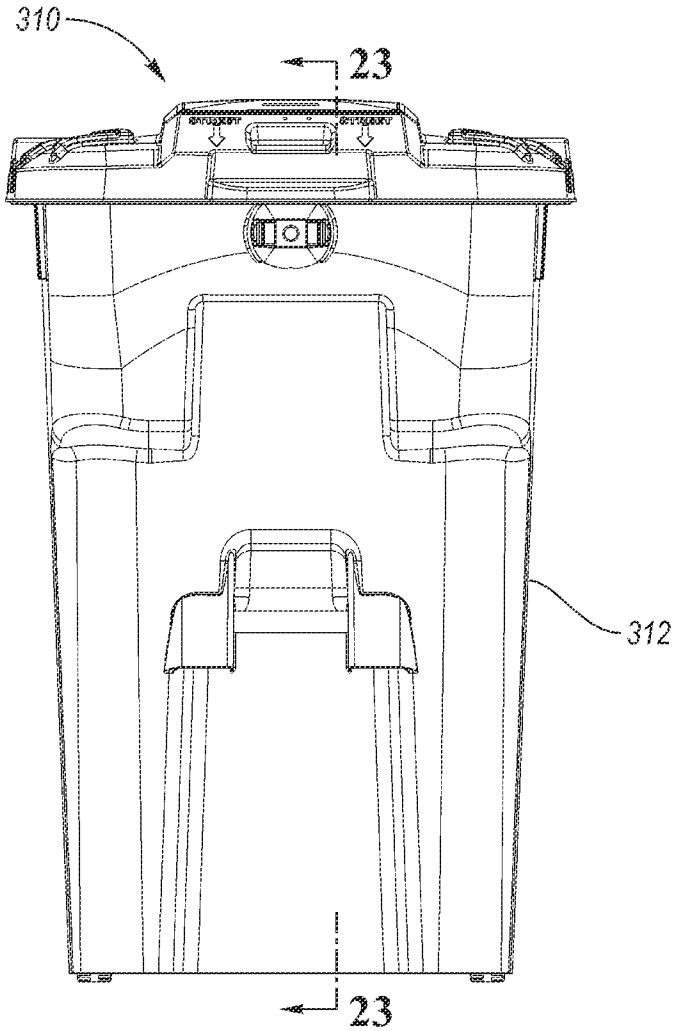
FIG. 22 is a front view of the roll-out cart of FIG. 19.
Figure 23:
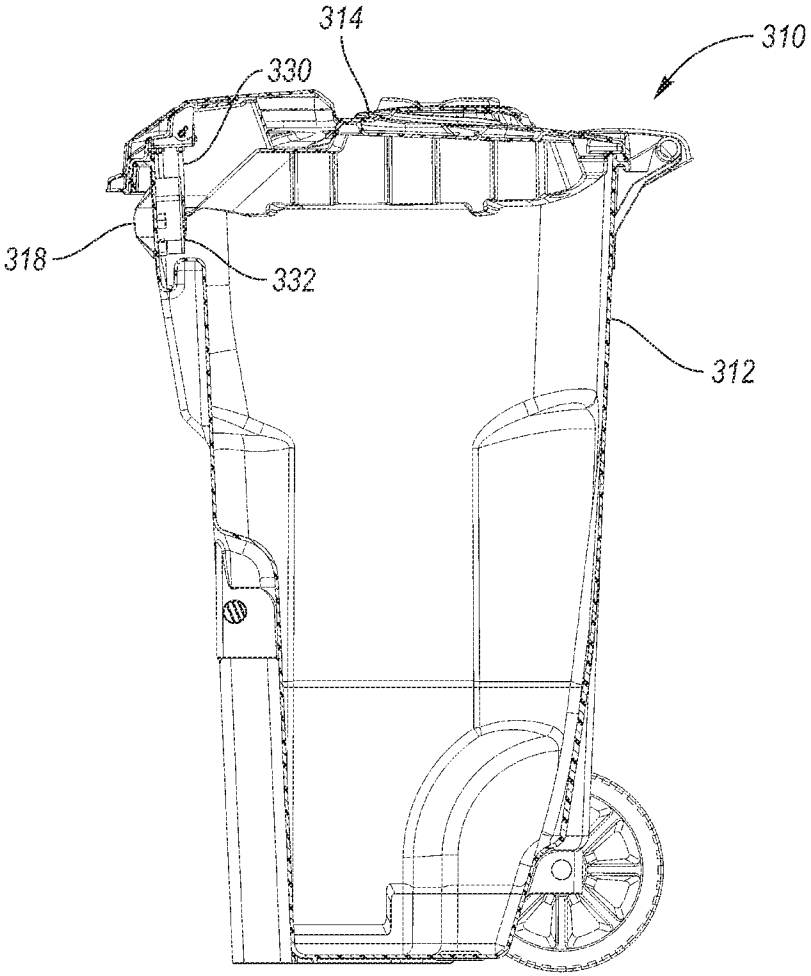
FIG. 23 is a section view taken along line 23-23 of FIG. 22.

FIG. 22 is a front view of the roll-out cart 310. FIG. 23 is a section view taken along line 23-23 of FIG. 22. Referring to FIG. 23, the outer latch assembly connects to the internal latch assembly 332 which selectively connects to the hasp 330 which is secured to the lid 314.

Figure 24:
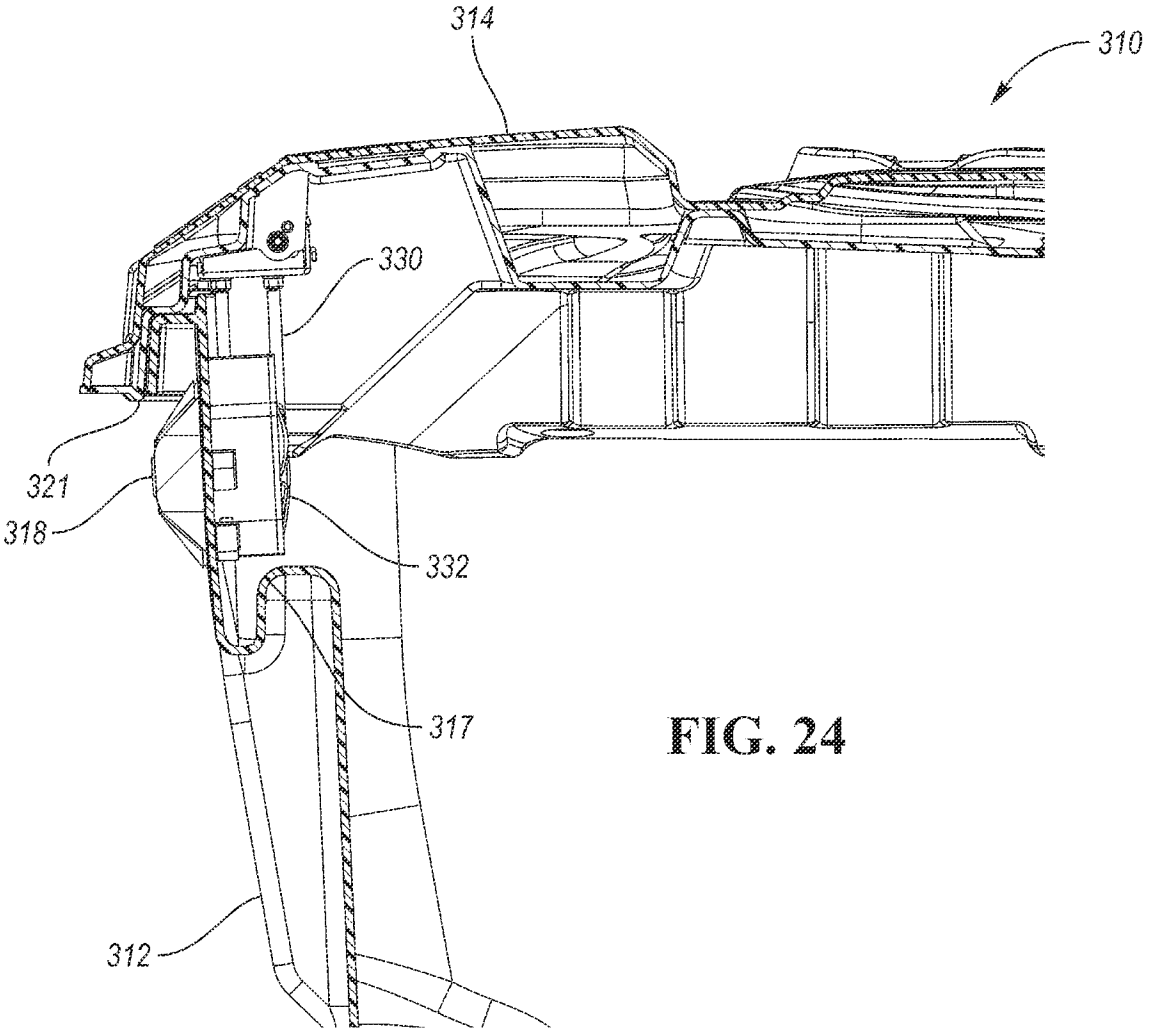
FIG. 24 is an enlarged view of the latch area of FIG. 23.

FIG. 24 is an enlarged view of the latch area of FIG. 23. Again, the outer latch assembly 328 connects to the internal latch assembly 332 to release the hasp 330 when the actuators are actuated. The upper grab point 317 is below and recessed relative to the guard 320 and outer latch assembly 318. The outer latch assembly 318 is positioned just below the lip 321.

Figure 25:
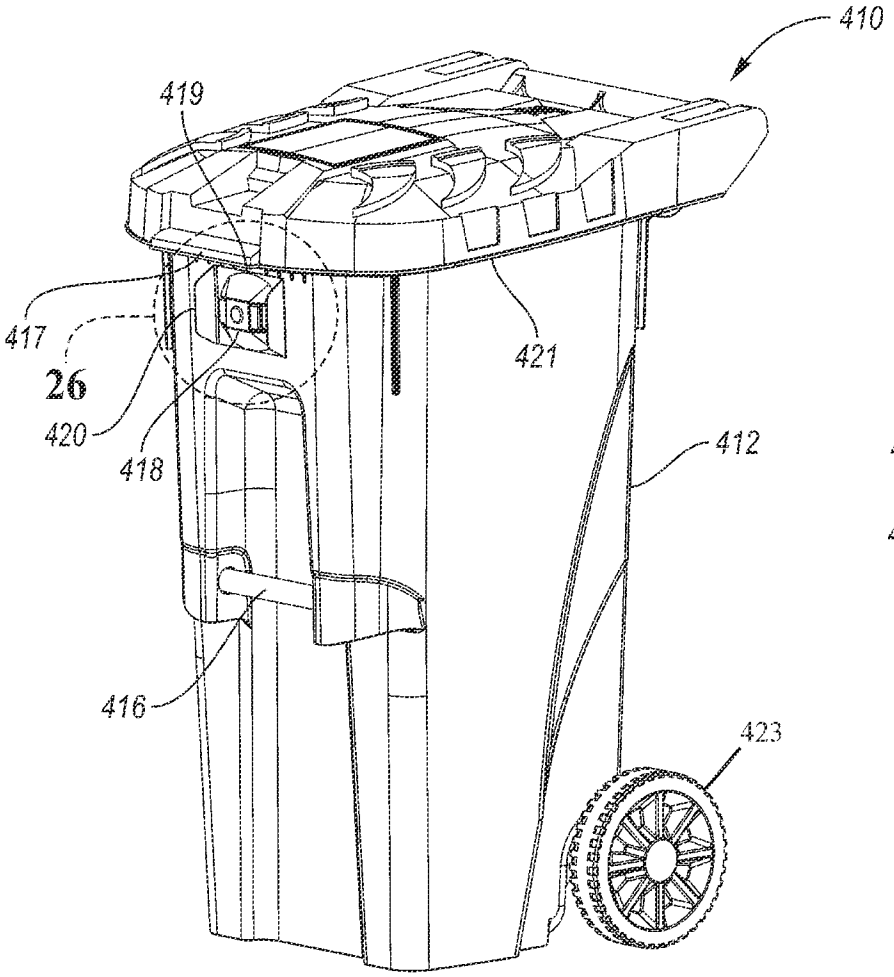
FIG. 25 is a front perspective view of a roll-out cart according to another embodiment.

A roll-out cart 410 according to another embodiment is shown in FIG. 25. The roll-out cart 410 includes a container body 412 and lid 414. The lid 414 is pivotably connected at a rearward portion of the roll-out cart 410. The lid 414 is selectively connected to the container body 412 at a forward portion of the roll-out cart 410 by a latch 419 including an outer latch assembly 418. The latch 419 is secured to the container body 412 and selectively captures a latch member secured to the front portion of the lid 414 as before. To prevent actuation of the latch 419 by animals, particularly bears, or inadvertent actuation, a guard 420 is provided around the outer latch assembly 418. The container body 412 has a yet smaller volume compared to the container body of the previous embodiments, for example, approximately 35 gallons.

The front of the container body 412 has a horizontal grab bar 416 which provides a lower grab point. The front of the container body 412 also includes an upper grab point 417, which in this embodiment is the front of the lip 421, molded integrally with the container body 412. Both the grab bar 416 and the upper grab point 417 are used by automated equipment for lifting and dumping the roll-out cart 410 into a collection vehicle.

The container body 412 includes a side wall extending upward from a base wall to a mouth of the container body 412. The lip 421 projects outward and then downward from the entire periphery of the uppermost edge of the side wall. The outer latch assembly 418 is positioned just below the lip 421. Wheels 423 are mounted to a lower rear portion of the container body 412.

Figure 26:
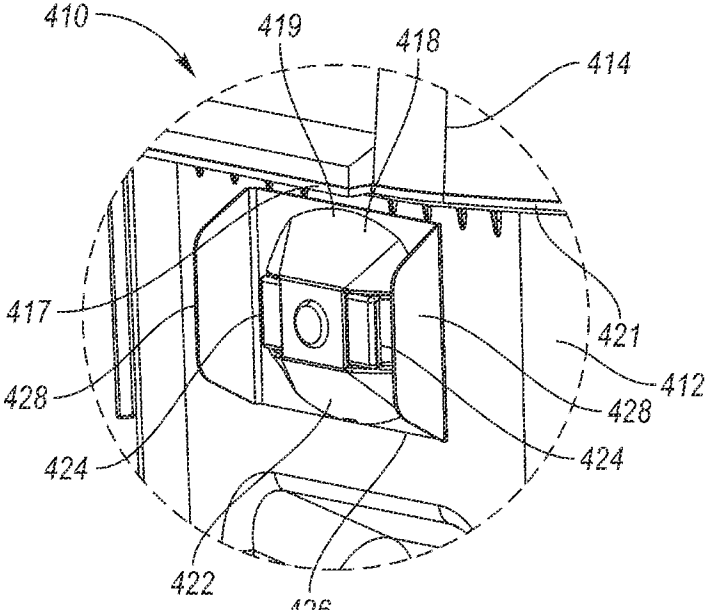
FIG. 26 is an enlarged view of the area of the latch and guard of FIG. 25.

FIG. 26 is an enlarged view of the area of latch 419 of FIG. 25. A pair of latch actuators 424 are positioned on opposite sides of the latch body 422. When a user grasps both latch actuators 424 in one hand and squeezes them toward one another, then the internal latch assembly 32 (FIG. 13) releases the hasp (not shown, as before), thereby releasing the lid 414 from the container body 412. The guard 420 prevents a bear or other animal from biting the outer latch assembly 418 and squeezing the latch actuators 424 toward one another. The guard 420 includes a rear plate portion 426 and a pair of opposite fins 428 protruding outward (forward) therefrom. The guard 420 defines a recess between the fins 428 in which the outer latch assembly 418, particularly the latch actuators 424, are received. The outer latch assembly 418 is positioned between the fins 428 such that the fins 428 are aligned with and spaced outward of the latch actuators 424. There is sufficient space between the fins 428 and the latch actuators 424 to permit a user's fingers to be inserted therebetween and squeeze the actuators 424. There is not sufficient space for an animal's upper or lower jaw to fit between either of the fins 428 and one of the actuators 424.

Figure 28:
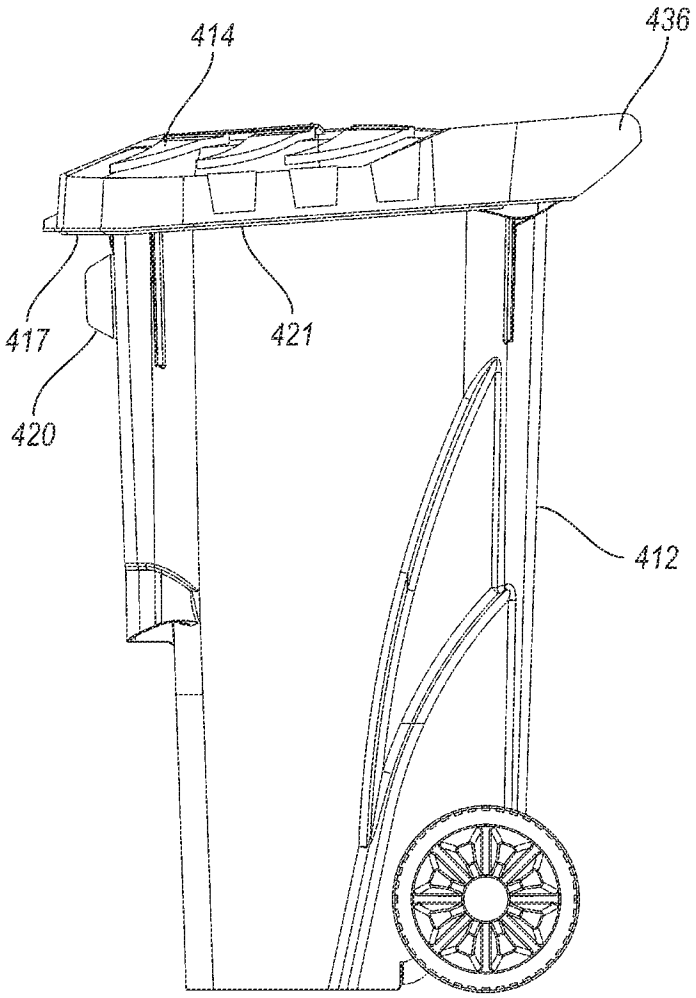
FIG. 28 is a side view of the roll-out cart of FIG. 25.
Figure 27:
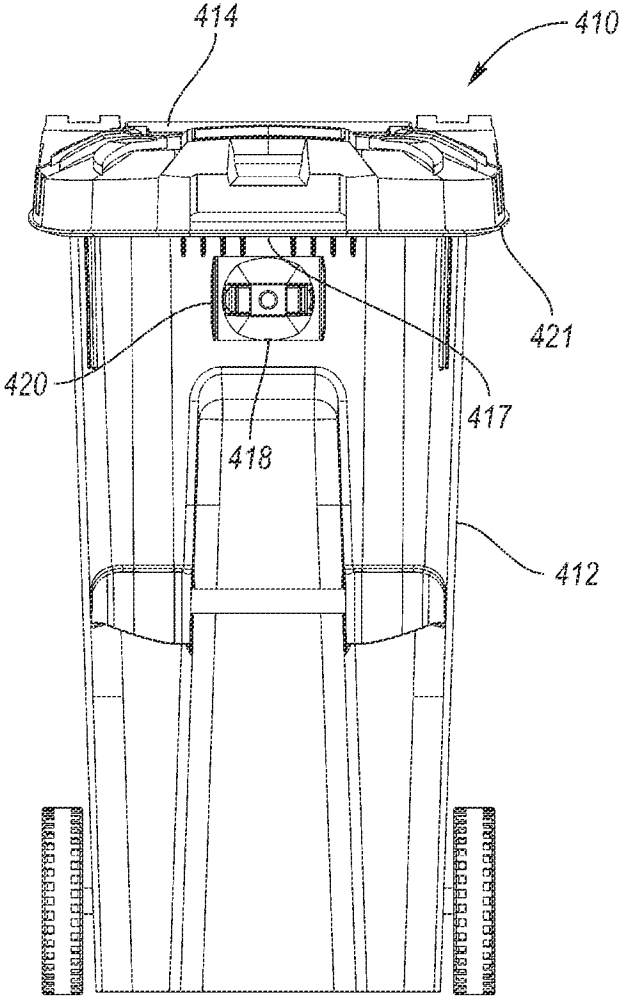
FIG. 27 is a front view of the roll-out cart of FIG. 25.

FIG. 27 is a front view of the roll-out cart 410. FIG. 28 is a side view of the roll-out cart 410. The lid 414 pivots on an axis 436 positioned rearward of the container body 412 side wall. The axis 436 extends through a rear handle. As shown, the upper grab point 417, i.e. the front of the lip 421, projects outward further than the guard 420. This leaves room for the hook or arm to be inserted under the lip 421 in front of the guard 420 and outer latch assembly 418.

Figure 29:
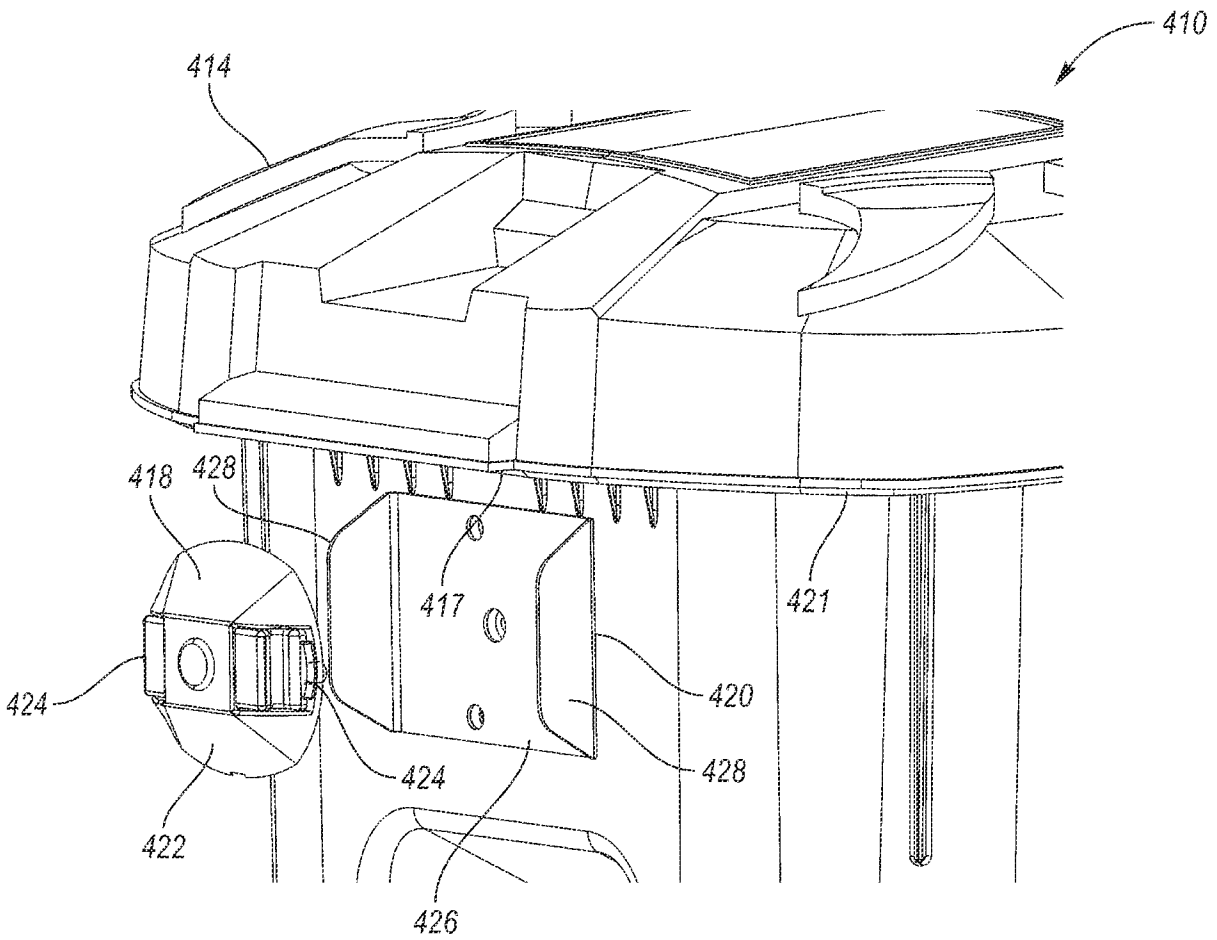
FIG. 29 is a partially exploded view of the latch area of the roll-out cart of FIG. 25.

FIG. 29 is a partially exploded view of the latch area of the roll-out cart 410. As shown, the guard 420 is placed against the container body 412, with the rear plate portion 426 abutting the container body 412 and the fins 428 protruding forwardly of the rear plate portion 426. The outer latch assembly 418 is installed over the rear plate portion 426 and secured to the container body 412 (and the internal latch assembly) to retain the rear plate portion 426. Again, the upper grab point 417, the front of the lip 421, projects forward of the guard 420 and outer latch assembly 418 when assembled.

Figure 30:
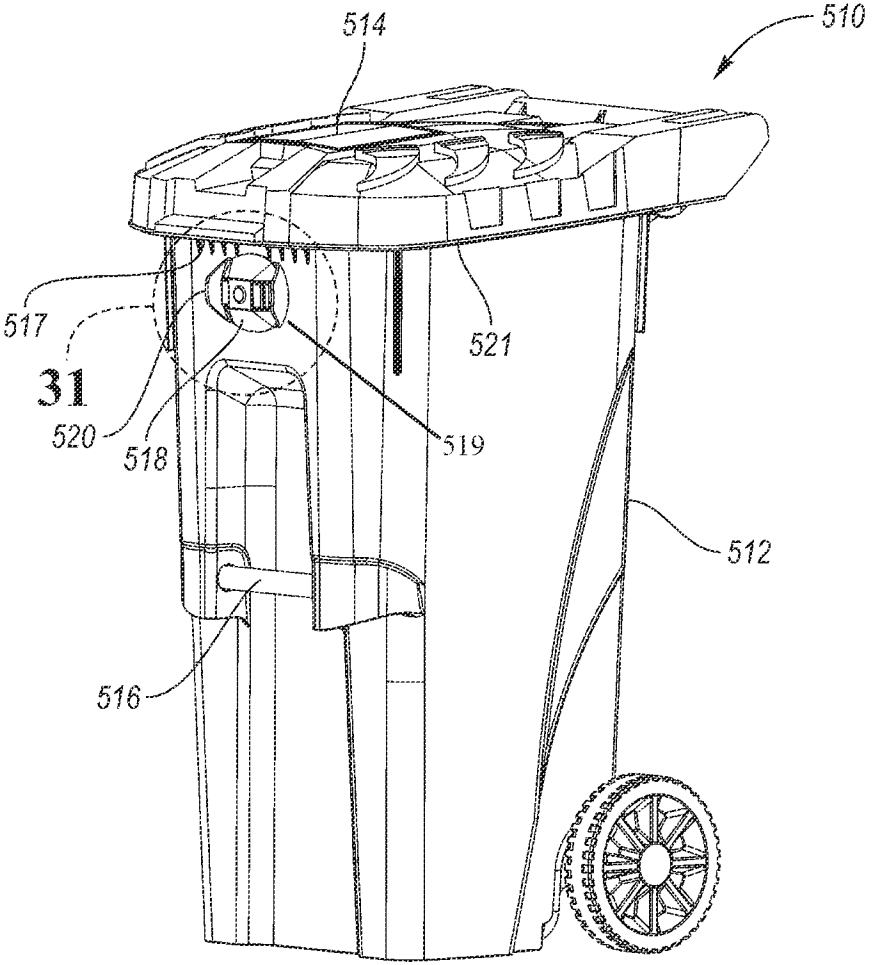
FIG. 30 is a front perspective view of a roll-out cart according to another embodiment.

FIGS. 30-35 show an alternate roll-out cart 510, including a container body 512 and lid 514. The container body 512 of FIG. 30 is the same as the container body 412 of FIG. 25 (e.g. 35 gallons). A latch 519 selectively connects the front portion of the container body 512 to the front portion of the lid 514. The latch 519 includes an outer latch assembly 518. Again, the upper grab point 517, the front of the lip 521, projects forward of the guard 520 and outer latch assembly 518. The front of the container body 512 has a horizontal grab bar 516 which provides a lower grab point.

Figure 31:
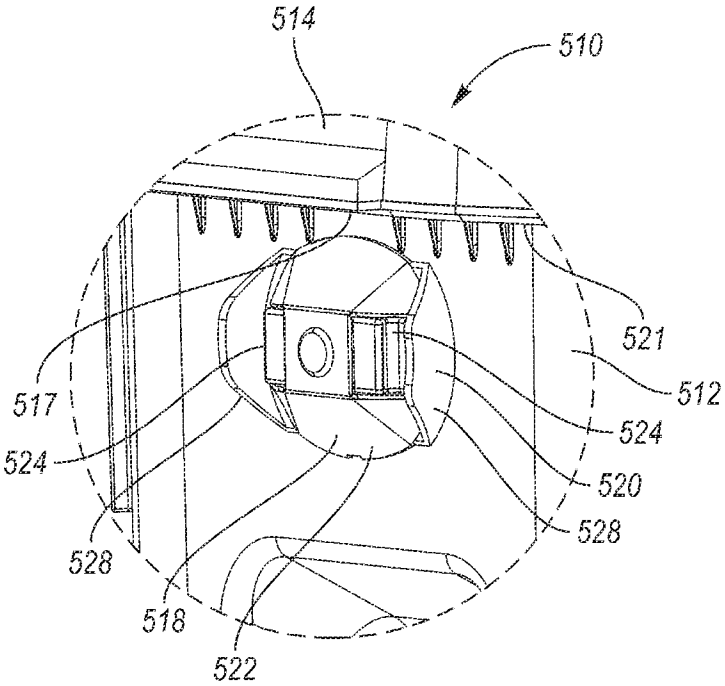
FIG. 31 is an enlarged view of the area of the latch and guard of FIG. 30.

FIG. 31 is an enlarged view of the outer latch assembly 518. The outer latch assembly 518 includes a latch body 522 having a pair of opposed actuators 524. In this embodiment, the outer latch assembly 518 includes an integrally-formed guard 520, including integrally-formed fins 528 protruding forwardly on either side of the outer latch assembly 518. The fins 528 are formed integrally with the latch body 522 of the outer latch assembly 518. Again, the fins 528 are spaced outwardly of the latch actuators 524 sufficiently to permit access by a user's fingers, but not the jaws of an animal. The latch actuators 524 and the latch body 522 are positioned in this recess defined by the fins 528 of the guard 520. The outer latch assembly 518 again connects to the internal latch assembly as before.

Figure 32:
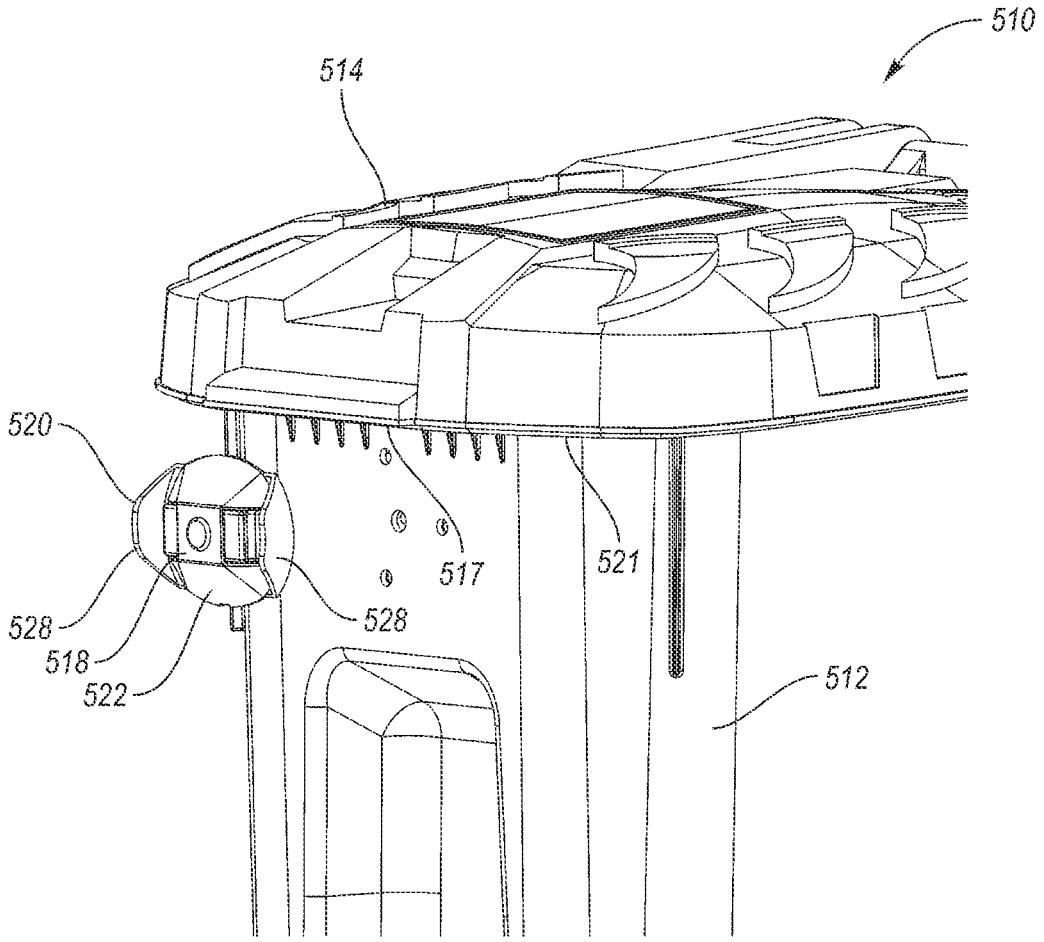
FIG. 32 is a partially exploded view of the latch area of the roll-out cart of FIG. 30.

FIG. 32 is a partially exploded view of the roll-out cart 510. As shown, the fins 528 are formed integrally with the latch body 522 of the outer latch assembly 518, which can be mounted to the container body 512.

Figure 33:
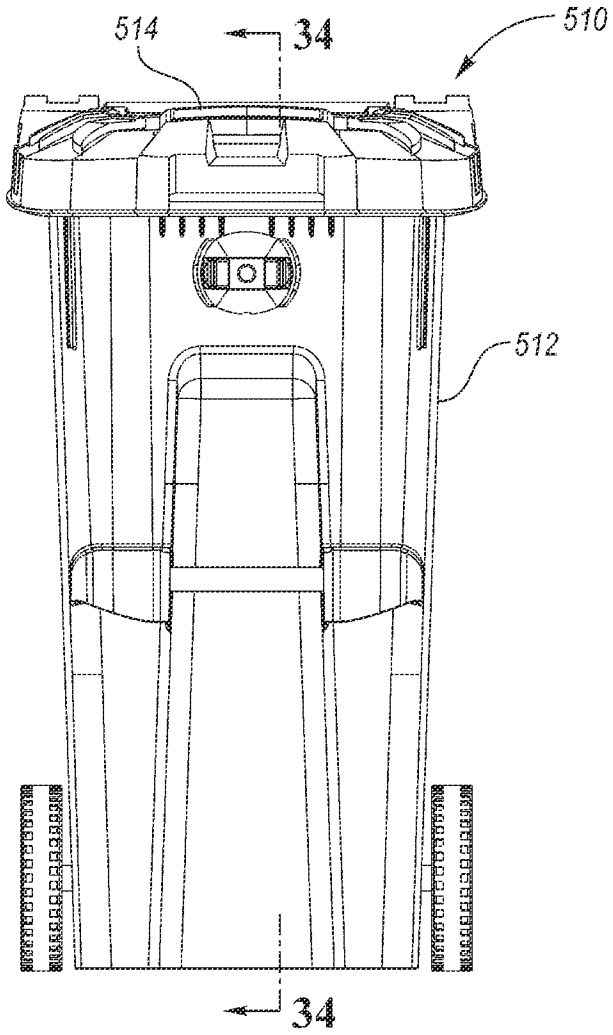
FIG. 33 is a front view of the roll-out cart of FIG. 30.
Figure 34:
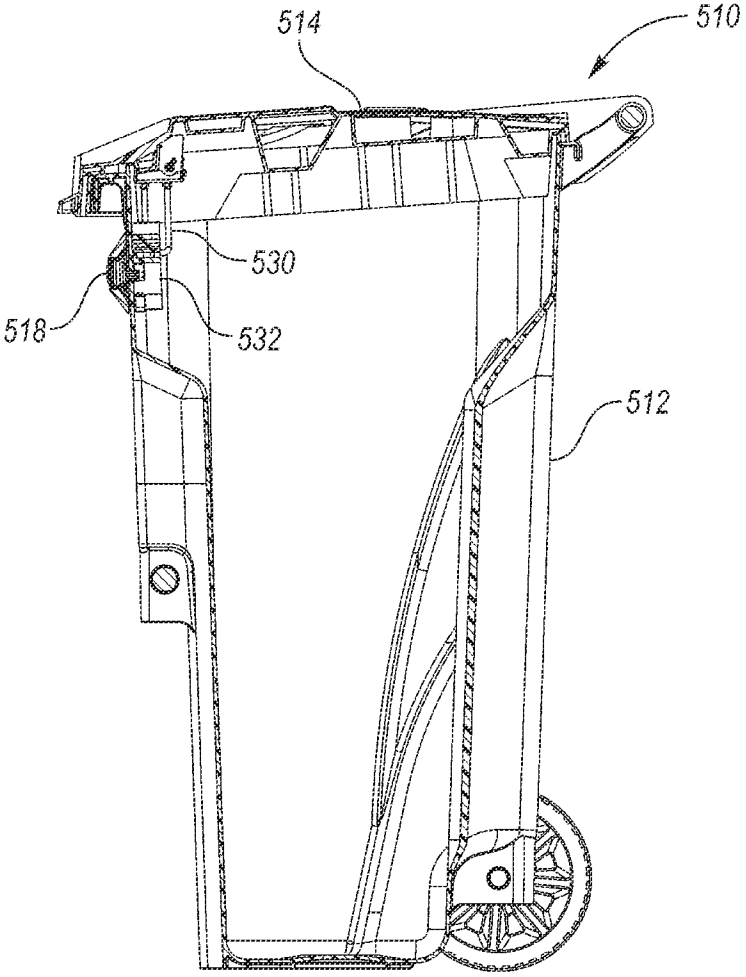
FIG. 34 is a section view taken along line 34-34 of FIG. 33.

FIG. 33 is a front view of the roll-out cart 510. FIG. 34 is a section view of the roll-out cart 510 taken along line 34-34 of FIG. 33. Referring to FIG. 34, the outer latch assembly 518 connects to the internal latch assembly 532 which selectively connects to the hasp 530 which is secured to the lid 514.

Figure 35:
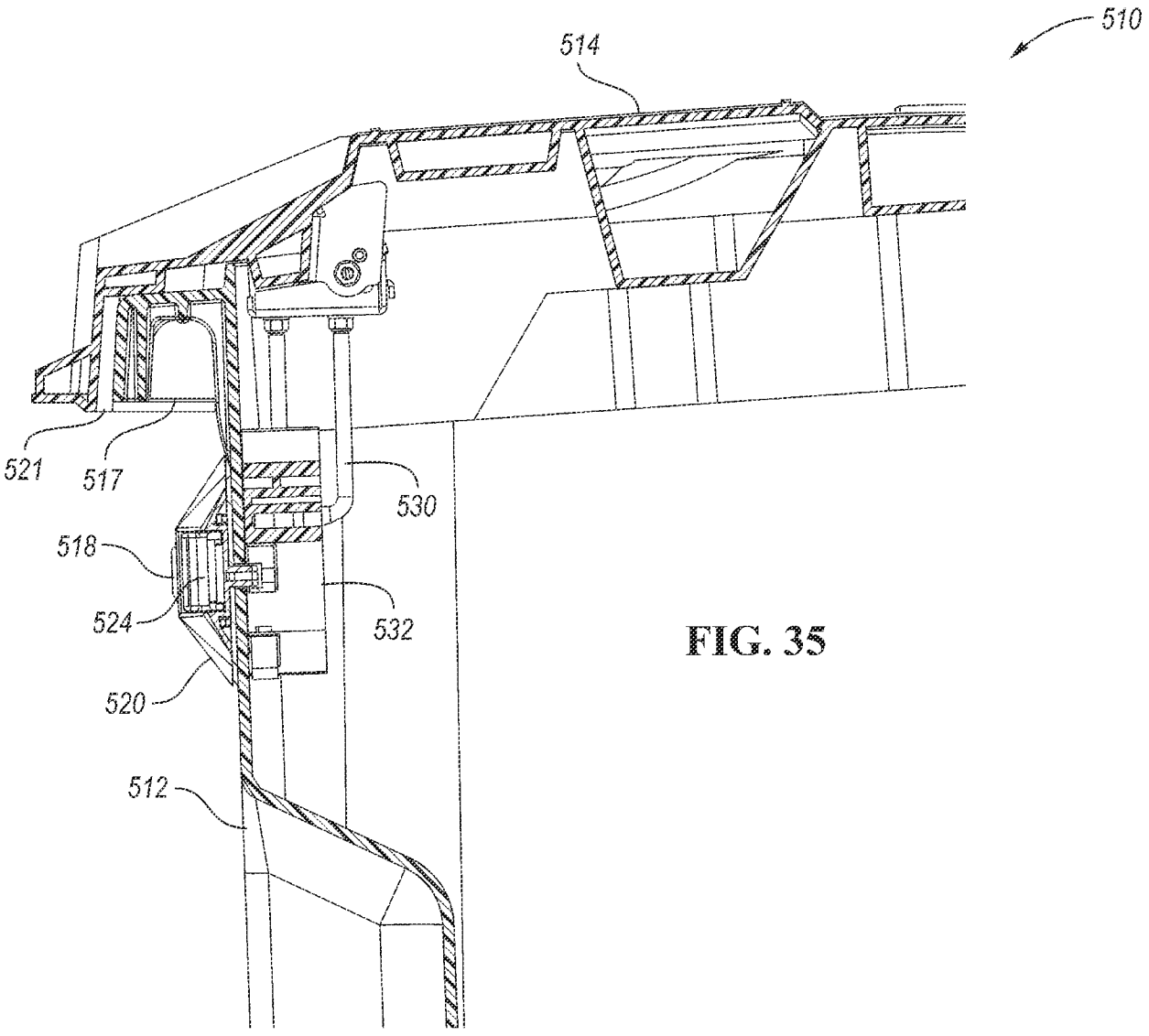
FIG. 35 is an enlarged view of the latch area of the roll-out cart of FIG. 34.

FIG. 35 is an enlarged view of the latch area of FIG. 34. Again, the outer latch assembly 528 connects to the internal latch assembly 532 through the wall of the container body 512 to release the hasp 530 when the actuators 524 are actuated. The upper grab point 517, the front of the lip 521, projects forward of the guard 520 and outer latch assembly 518. The outer latch assembly 518 and guard 520 may have a reduced profile to permit the equipment to access the upper grab point 517. The front of the lip 521 of the container body 512 is larger than that on the larger container bodies (the 95 gallon and 65 gallon embodiments) to provide access to the upper grab point 517 in front of the outer lock assembly 518 and guard 520.

The section view of the roll-out cart 410 of FIG. 25 would be identical to that of the container 510 of FIG. 35, other than having a separately formed guard 420. The container body 412 is identical to the container body 512, so the upper grab point 417 is the same as the upper grab point 517 in FIG. 35. The outer latch assembly 418 and guard 420, also have the reduced profile shown in the outer latch assembly 518 and guard 520 of FIG. 35.

In all of these embodiments, the container body and lid are preferably formed of a suitable plastic, while the outer latch assembly is a multi-component assembly mostly formed of metal components and the guard and fins are also formed of metal. Alternatively, the guard and fins could also be formed of a suitably hard plastic.

The lock guard protects the lock mechanism from inadvertent actuation or actuation by animals and could be used for any type of actuators. The guard limits and/or diverts compression, actuation, rotation or release away from the actuators of the latch, in whatever form they take. In the embodiments shown, the actuators are actuated by compression, but this invention is also applicable to actuators that operate via rotation, pivoting, or other motions or forces. The benefit of the guard can be achieved with several profiles, as long as the profile permits manual or automated access to the locking mechanism.

As another alternative, the guard could comprise a recess in the front wall of the container body, which may be defined between protrusions formed by the front wall of the container body. The outer latch assembly would be received in the recess and/or between the protrusions. Alternatively, the recess/protrusions in the front wall of the container body can be used in combination with a separately-formed, metal or plastic guard to define the recess for receiving the outer latch assembly.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A container comprising:

a container body having a side wall extending upward to a mouth of the container body;

a lid pivotably connected to a rear portion of the container body, the lid pivotable between an open position and a closed position covering the mouth of the container body;

a latch selectively securing a front portion of the lid to a front portion of the container body, the latch including an outer latch assembly having a first actuator and a second actuator, wherein the latch selectively releases the front portion of the lid from the front portion of the container body upon movement of the first and second actuators toward one another; and a guard defining a recess on the front portion of the container body between a first portion and a second portion of the guard, wherein the first portion and the second portion are forward-most surfaces of the guard, wherein the first portion and the second portion project forward such that the first actuator and the second actuator are between the first portion and the second portion of the guard, wherein the first actuator of the latch is within the recess of the guard such that the first and second actuators are recessed rearwardly of the first portion and the second portion of the guard, and wherein the guard is open forwardly such that the first and second actuators are accessible from the forward direction.

2. The container of claim 1 wherein the guard includes at least one fin projecting from the front portion of the container body.

3. The container of claim 2 wherein the at least one fin of the guard includes a pair of fins between which is defined the recess, wherein the pair of fins project forward adjacent the first and second actuators such that the first and second actuators are between the pair of fins.

4. The container of claim 3 wherein the fins are formed integrally with the outer latch assembly.

5. A container comprising:

a container body having a side wall extending upward to a mouth of the container body;

a lid pivotably connected to a rear portion of the container body, the lid pivotable between an open position and a closed position covering the mouth of the container body;

a latch selectively securing a front portion of the lid to a front portion of the container body, the latch including an outer latch assembly having a first actuator; and a guard including a pair of fins between which is defined a recess on the front portion of the container body, wherein the first actuator of the latch is within the recess, wherein the guard includes a rear plate portion formed integrally with the pair of fins, wherein the rear plate portion is positioned between the outer latch assembly and the container body.

6. The container of claim 3 wherein the lid is hingeable about an axis through a rear handle portion.

7. The container of claim 1 further including a grab bar secured to the front portion of the container body and wherein the container body further includes an upper grab point molded into the front portion above the grab bar.

8. The container of claim 7 wherein the upper grab point is below the outer latch assembly.

9. The container of claim 7 wherein the upper grab point is above the outer latch assembly.

10. The container of claim 9 wherein the container body includes a lip projecting outward and downward from at least a portion of a periphery of the mouth, and wherein the upper grab point is a portion of the lip.

11. A container comprising:

a container body having a side wall extending upward to a mouth of the container body, wherein the container body includes a lip projecting outward and then downward from at least a portion of a periphery of the mouth, wherein a front portion of the lip defines an upper grab point for automated handling equipment;

a lid pivotably connected to a rear portion of the container body, the lid pivotable between an open position and a closed position covering the mouth of the container body;

a latch selectively securing a front portion of the lid to a front portion of the container body, the latch including an outer latch assembly having a first actuator configured to release the latch upon movement of the first actuator in a first direction relative to the container body, wherein the outer latch assembly is positioned below the upper grab point, such that at least a portion of the upper grab point projects forwardly of the outer latch assembly; and a guard defining a recess on the front portion of the container body, wherein the first actuator of the latch is within the recess, wherein a first portion of the guard is the forward-most surface of the guard and is aligned with and spaced from the first actuator in a second direction opposite the first direction sufficiently to permit access to the first actuator by a human's fingers between the first actuator and the first portion of the guard in a direction perpendicular to the front portion of the container body, and wherein the guard is open in the perpendicular direction.

12. The container of claim 11 further including a grab bar secured to the front portion of the container body.

13. The container of claim 12 wherein the outer latch assembly includes a second actuator, wherein the latch selectively releases the front portion of the lid from the front portion of the container body upon movement of the first and second actuators toward one another.

14. The container of claim 13 wherein the first and second actuators are within the recess of the guard such that a second portion of the guard is spaced away from and aligned with the second actuator in the first direction.

15. The container of claim 14 wherein the guard includes at least one fin projecting from the front portion of the container body.

16. The container of claim 15 wherein the at least one fin of the guard includes a pair of fins between which is defined the recess.

17. The container of claim 16 wherein the fins are formed integrally with the outer latch assembly.

18. The container of claim 16 wherein the guard includes a rear plate portion formed integrally with the pair of fins, wherein the rear plate portion is positioned between the outer latch assembly and the container body.

19. A container comprising:

a container body having a side wall extending upward to a mouth of the container body;

a lid pivotably connected to a rear portion of the container body, the lid pivotable between an open position and a closed position covering the mouth of the container body;

a latch selectively securing a front portion of the lid to a front portion of the container body, the latch including an outer latch assembly having a first actuator and a second actuator, wherein the latch is configured to release the the lid from the front portion of the container body upon movement of the first and second actuators toward one another with the first actuator moving in a first direction relative to the container body; and a guard defining a recess on the front portion of the container body, wherein the first actuator and the second actuator of the latch are within the recess of the guard, wherein a first portion of the guard is spaced away from and aligned with the first actuator in a second direction opposite the first direction, and a second portion of the guard is spaced away from and aligned with the second actuator in the first direction, wherein the first and second actuators are between the first portion and the second portion of the guard, wherein the first and second actuators are recessed rearwardly of forward-most surfaces of the guard, wherein the first and second actuators are between the forward-most surfaces of the guard and wherein the guard is open in a forward direction away from the latch.

20. The container of claim 19 wherein the guard includes a pair of fins between which is defined the recess, wherein the pair of fins project forward adjacent the first and second actuators such that the first and second actuators are between the pair of fins.

21. The container of claim 19 wherein the first portion of the guard is configured so that a user can insert a finger between the first portion of the guard and the first actuator before moving the first actuator to release the latch.

* * * * *